US012565732B2

(12) United States Patent
Jung

(10) Patent No.: US 12,565,732 B2
(45) Date of Patent: Mar. 3, 2026

(54) LAUNDRY PROCESSING APPARATUS

(71) Applicant: LG Electronics Inc., Seoul (KR)

(72) Inventor: Sungwoon Jung, Seoul (KR)

(73) Assignee: LG Electronics Inc., Seoul (KR)

( * ) Notice: Subject to any disclaimer, the term of this patent is extended or adjusted under 35 U.S.C. 154(b) by 105 days.

(21) Appl. No.: 18/574,592

(22) PCT Filed: Jun. 14, 2022

(86) PCT No.: PCT/KR2022/008346
§ 371 (c)(1),
(2) Date: Dec. 27, 2023

(87) PCT Pub. No.: WO2023/277399
PCT Pub. Date: Jan. 5, 2023

(65) Prior Publication Data

US 2024/0318371 A1 Sep. 26, 2024

(30) Foreign Application Priority Data

Jun. 28, 2021 (KR) ..... 10-2021-0084019

(51) Int. Cl.
*D06F 39/02* (2006.01)
*D06F 39/12* (2006.01)

(52) U.S. Cl.
CPC ..... *D06F 39/02* (2013.01); *D06F 39/022* (2013.01); *D06F 39/024* (2013.01); *D06F 39/12* (2013.01)

(58) Field of Classification Search
None
See application file for complete search history.

(56) References Cited

U.S. PATENT DOCUMENTS

2012/0167637 A1* 7/2012 Mun ..... D06F 39/022 222/145.5
2016/0194805 A1 7/2016 Pellegrin et al.

FOREIGN PATENT DOCUMENTS

| | | |
|---|---|---|
| CN | 201172750 | 12/2008 |
| CN | 204151574 | 2/2015 |
| CN | 210177196 | 3/2020 |
| EP | 2003237 A1 | 12/2008 |

(Continued)

OTHER PUBLICATIONS

Notice of Allowance in Korean Appln. No. 10-2021-0084019, mailed on Feb. 13, 2025, 3 pages (with English translation).

(Continued)

*Primary Examiner* — Levon J Shahinian
(74) *Attorney, Agent, or Firm* — Fish & Richardson P.C.

(57) ABSTRACT

A laundry processing apparatus is provided, and a laundry processing apparatus according to an embodiment of the present disclosure includes a cabinet, a tub, a drum, and a detergent supply device, wherein the detergent supply device includes: a storage unit in which detergent is stored and which is introduced into or drawn out of the cabinet through a detergent opening; and a front case located at a rear side of the detergent opening, having a portion of the storage unit accommodated therein, and including a rear wall through which the rest of the storage unit extends, wherein the front case includes a stopper located at a front side of the rear wall and provided to protrude toward the storage unit to limit the withdrawal distance of the storage unit having been introduced in the cabinet.

21 Claims, 25 Drawing Sheets

(56) References Cited

FOREIGN PATENT DOCUMENTS

| | | | |
|---|---|---|---|
| EP | 3064633 | | 9/2016 |
| EP | 2617888 | B1 | 4/2019 |
| KR | 10-1748773 | | 7/2012 |
| KR | 10-2021-0009650 | A | 1/2021 |
| WO | 2018/108074 | A1 | 6/2018 |

OTHER PUBLICATIONS

International Search Report and Written Opinion in Appln. No. PCT/KR2022/008346, mailed on Sep. 23, 2022, 22 pages (with English translation).
Extended European Search Report in European Appln. No. 22833455.3, mailed on May 20, 2025, 8 pages.

* cited by examiner

150

LAUNDRY PROCESSING APPARATUS

CROSS-REFERENCE TO RELATED APPLICATIONS

This application is a National Stage application under 35 U.S.C. § 371 of International Application No. PCT/KR2022/008346, filed on Jun. 14, 2022, which claims the benefit of Korean Application No. 10-2021-0084019, filed on Jun. 28, 2021. The disclosures of the prior applications are incorporated by reference in their entirety.

TECHNICAL FIELD

The present disclosure relates to a laundry treatment apparatus, and more particularly to a laundry treatment apparatus equipped with a detergent supply device.

BACKGROUND ART

A laundry treatment apparatus may refer to a device that removes contamination from laundry (e.g., clothes, bedding, etc. hereinafter referred to as "laundry") put into a drum. The laundry treatment apparatus may perform washing, rinsing, dehydration, drying, etc. of laundry put into a drum. The laundry treatment apparatuses can be classified into a front-loading type laundry treatment device in which laundry is put into a drum through an inlet provided at a front surface of the front-loading type laundry treatment device, and a top-loading type laundry treatment device in which laundry is put into a drum through an inlet provided at a top surface of the top-loading type laundry treatment device.

The laundry treatment apparatus may include a housing forming an exterior appearance thereof, a tub disposed in the housing, a drum rotatably mounted in the tub into which laundry is placed, and a detergent supply device for supplying detergent to the inside of the drum.

When the drum is rotated by a motor while wash water is supplied to laundry placed in the drum, contaminants (dirt) on the laundry can be removed by friction between laundry and water in the rotating drum.

The detergent supply device may include a detergent supply function to enhance the washing effect. Here, detergent may refer to substances for enhancing the washing effect, for example, fabric detergent, fabric softener, and bleach. Such detergents may be broadly classified into powdered detergent and liquid detergent.

Meanwhile, Korean Patent Laid-Open Publication No. 10-2018-0090003 A1 has disclosed a detergent supply device included in a laundry treatment apparatus. The laundry treatment apparatus may be used in a manner that a storage unit in which detergent is stored in the detergent supply device can be inserted into or withdrawn from a cabinet by a user.

However, if the user simply wants to replenish detergent in the storage unit, the operation of completely separating the storage unit from the cabinet may require a user-unfriendly process, such as a process of re-inserting the storage unit back into the cabinet after replenishing the detergent, resulting in inconvenience of use.

Therefore, it is important to effectively restrict a withdrawal distance of the storage unit to be withdrawn by the user in a general usage environment of the laundry treatment apparatus so that the user can conveniently use the storage unit.

The overall numerical characteristics of the laundry treatment apparatus may change during the manufacturing process of the laundry treatment apparatus due to various sizes of the tub and drum or various other configuration arrangements, and in response to these changes, it is very important to effectively secure a withdrawal distance that makes it easy to replenish detergent in at least the storage unit.

As the withdrawal distance of the storage unit installed in the laundry treatment apparatus increases, stability of the storage unit may decrease, so that it is important to develop a structure capable of effectively supporting the storage unit pulled out from the cabinet.

In addition, it is important to effectively improve the withdrawal distance of the storage unit by minimizing design changes in various configurations included in the detergent supply device and to develop a structure that can minimize additional design changes in each configuration even if the withdrawal distance of the storage unit changes.

DISCLOSURE

Technical Problem

An object of the present disclosure is to provide a laundry treatment apparatus that allows a user to conveniently use the storage unit by effectively restricting the withdrawal distance of the storage unit.

Another object of the present disclosure is to provide a laundry treatment apparatus that can effectively secure the withdrawal distance of the storage unit even if the numerical characteristics of the laundry treatment apparatus change.

Another object of the present disclosure is to provide a laundry treatment apparatus including a structure capable of stably and effectively supporting the storage unit pulled out from a cabinet.

Another object of the present disclosure is to provide a laundry treatment apparatus that can effectively improve the withdrawal distance of the storage unit while minimizing design changes of the detergent supply device, and can effectively enhance the structural stability of the detergent supply device.

Another object of the present disclosure is to provide a laundry treatment apparatus including a detergent supply device that has a structure that can be shared even when the withdrawal distance of the storage unit changes.

Technical Solutions

The laundry treatment apparatus according to one embodiment of the present disclosure may include a detergent supply device capable of effectively restricting the withdrawal distance of the storage unit. In addition, the withdrawal distance of the storage unit can be effectively improved in response to either a change in position of the detergent supply device or a numerical change of the cabinet.

The laundry treatment apparatus according to one embodiment of the present disclosure can effectively increase the withdrawal distance of the storage unit by improving the structure of the front case, the upper case, etc. of the detergent supply device, and other configurations can be shared regardless of the withdrawal distance of the storage unit.

In accordance with one embodiment of the present disclosure, even if the overall length of the cabinet is increased in the forward and backward directions, the detergent cup and the withdrawal restriction bar of the storage unit pulled out from the cabinet by a restricted withdrawal distance can be exposed to the outside through the detergent opening.

Meanwhile, coupling between the upper case and the front case can be achieved through an upper hook provided in the front case, and the function of the locking groove provided at the upper case can be effectively suppressed through the upper hook.

In addition, the laundry treatment apparatus according to one embodiment of the present disclosure can effectively prevent coupling between the upper hook and the upper case from being released through the panel reinforcement unit disposed at the rear side of the front panel.

Specifically, the laundry treatment apparatus according to the embodiment of the present disclosure may include a cabinet, a tub, a drum, and a detergent supply device. The cabinet may include a front panel in which a detergent opening is formed.

The tub may be provided in the cabinet to accommodate water. The drum may be rotatably provided in the tub to accommodate laundry. The detergent supply device may be provided in the cabinet to supply detergent into the tub.

The detergent supply device may include a storage unit and a front case. The storage unit may store detergent, and may be inserted into or withdrawn from the cabinet through the detergent opening.

The front case may be located at a rear side of the detergent opening, may accommodate at least a portion of the storage unit, and may include a rear wall penetrated by the storage unit.

The front case may include a stopper. The stopper may be located farther forward than the rear wall, and may protrude toward the storage unit to restrict a withdrawal distance of the storage unit inserted into the cabinet.

The front case may include an opening circumferential wall and a front extension unit. The opening circumferential wall may be located at a rear side of the detergent opening, the rear wall may be connected to the rear end of the front case, and the opening circumferential wall may extend along the circumference of the rear wall. The stopper may be provided in the front extension unit to protrude toward the storage unit.

A sliding protrusion extending in a movement direction of the storage unit may be provided at a sidewall of the storage unit. A sliding groove extending in the movement direction to allow the sliding protrusion to be slid therein may be provided at a portion facing the sliding protrusion within the front extension unit.

The detergent supply device further includes a lower case that is located at a rear side of the front case to accommodate a remainder of the storage unit. The sliding groove may extend along inner surfaces of the front extension unit and the lower case.

The front extension unit may include a first extension unit located above the storage unit and provided with a stopper, and a second extension unit that extends downward from the end portion of the first extension unit and includes the sliding groove.

An extension length of the opening circumferential wall extending from the rear wall may be longer than an extension length of the front extension unit. The stopper may be located farther backward than a front end of the front extension unit.

The portion of the storage unit may include an extension-unit receiving groove into which the front extension unit is inserted from a rear side of the front case.

The storage unit may include a restriction protrusion formed to overlap the stopper in a movement direction of the storage unit, whereby the restriction protrusion is in contact with the stopper during a withdrawal process of the storage unit so that a withdrawal distance of the storage unit is restricted.

The storage unit may include a withdrawal restriction bar, one end of which is fixed based on the movement direction and the other end of which forms a free end. The withdrawal restriction bar may be located at the withdrawal restriction bar so that a position thereof is changed by the other end of the withdrawal restriction bar. The other end of the withdrawal restriction bar may be exposed to the outside through the detergent opening in a state in which the restriction protrusion is in contact with the stopper.

The storage unit may further include a detergent cup having an opened upper surface to accommodate detergent therein. The detergent cup may be configured such that at least a portion of the opened upper surface is exposed to the outside in a state in which the restriction protrusion is in contact with the stopper.

The detergent supply device may further include an upper case disposed at a rear side of the front case and provided to cover the storage unit from an upper side of the storage unit. The front case may include an upper hook extending rearward from the rear wall such that the upper hook is fastened to the upper case and fixes the upper case.

The detergent supply device may further include a lower case. The lower case may be located at a rear side of the front case, may have an opened upper surface, and may accommodate a remainder of the storage unit. The upper case may be provided to cover the upper surface of the lower case.

The upper hook may be coupled to the upper case at an upper side of the upper case. The storage unit may include a restriction protrusion that overlaps the stopper in a movement direction of the storage unit.

The upper case may include a protrusion groove. The protrusion groove into which the restriction protrusion is inserted in a withdrawal process of the storage unit may be formed at one surface facing the storage unit within the upper case, so that forward movement of the storage unit is restricted. The restriction protrusion may be prevented from being inserted into the protrusion groove by a hook protrusion caught on the upper case.

The restriction protrusion, the protrusion groove, the hook protrusion, and the stopper may be aligned in parallel to each other with respect to the movement direction.

The upper case may include an open hole for allowing the inside of the protrusion groove to communicate with the outside of the upper case. The hook protrusion may be inserted into the protrusion groove through the open hole so as to prevent the stopper from being inserted into the protrusion groove.

The cabinet may further include a panel reinforcement unit coupled to the front panel at the rear side of the front panel. The panel reinforcement unit may include a coupling reinforcement unit that protrudes toward the upper hook to prevent separation between the upper hook and the upper case.

The panel reinforcement unit may include: a main reinforcement unit coupled to the front panel, and an extension reinforcement unit configured to extend rearward from the main reinforcement unit. The coupling reinforcement unit may be provided in the extension reinforcement unit, and may protrude toward the upper hook.

In accordance with one embodiment of the present disclosure, a laundry treatment apparatus may include a cabinet, a tub, a drum, and a detergent supply device provided in the cabinet to supply detergent into the tub or the drum. The detergent supply device may include a storage unit and a front case. The front case may include a front extension unit extending forward from the rear wall. A sliding protrusion extending in a movement direction of the storage unit may be provided at a sidewall of the storage unit. A sliding groove extending in the movement direction to allow the sliding protrusion to be slid therein may be provided at a portion facing the sliding protrusion within the front extension unit.

In accordance with another embodiment of the present disclosure, a laundry treatment apparatus may include a cabinet, a tub, a drum, and a detergent supply device provided in the cabinet to supply detergent into the tub or the drum. The detergent supply device may include a storage unit, a front case, and an upper case. The front case may include an upper hook extending rearward from the rear wall such that the upper hook is fastened to the upper case and fixes the upper case.

Advantageous Effects

As is apparent from the above description, the embodiments of the present disclosure may provide a laundry treatment apparatus that allows a user to conveniently use the storage unit by effectively restricting the withdrawal distance of the storage unit.

The embodiments of the present disclosure may provide a laundry treatment apparatus that can effectively secure the withdrawal distance of the storage unit even if the numerical characteristics of the laundry treatment apparatus change.

The embodiments of the present disclosure may provide a laundry treatment apparatus including a structure capable of stably and effectively supporting the storage unit pulled out from a cabinet.

The embodiments of the present disclosure may provide a laundry treatment apparatus that can effectively improve the withdrawal distance of the storage unit while minimizing design changes of the detergent supply device, and can effectively enhance the structural stability of the detergent supply device.

The embodiments of the present disclosure may provide a laundry treatment apparatus including a detergent supply device that has a structure that can be shared even when the withdrawal distance of the storage unit changes.

BEST MODE

Figure 1:
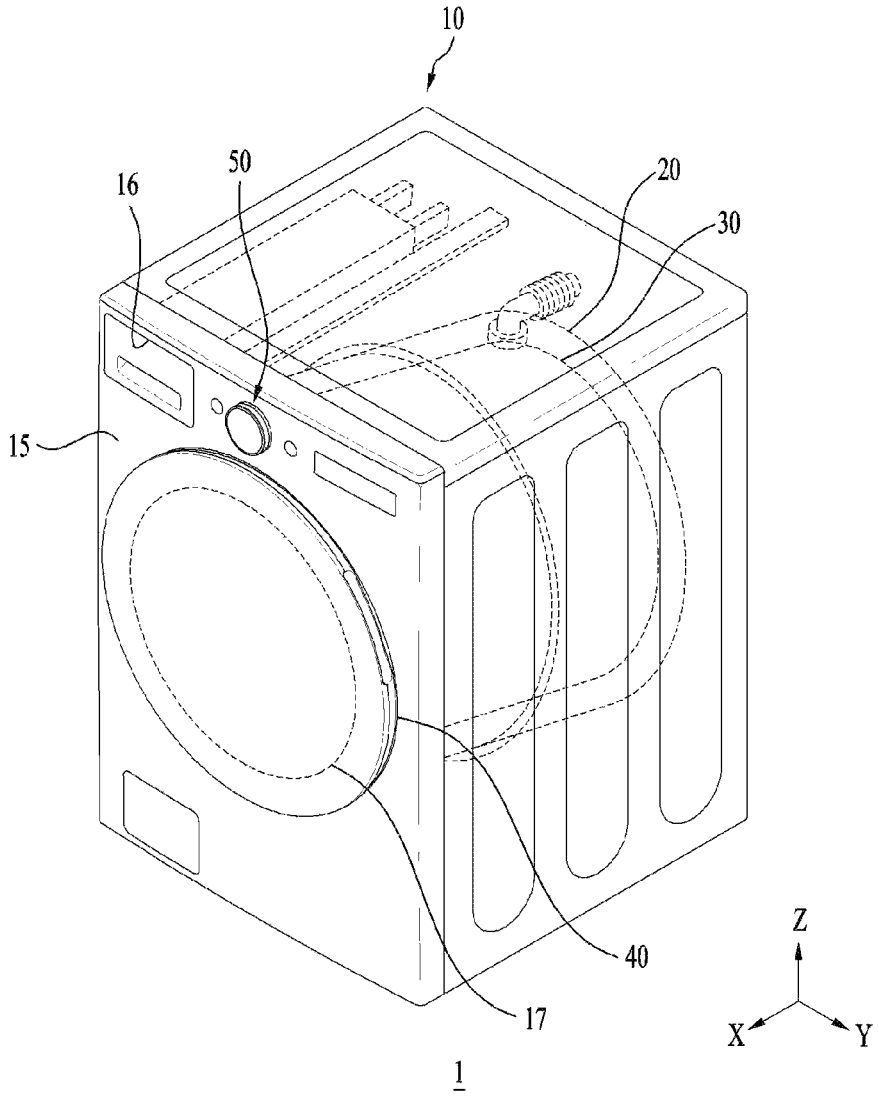
FIG. 1 is a perspective view illustrating a laundry treatment apparatus according to an embodiment of the present disclosure.

Hereinafter, embodiments of the present disclosure will be described in detail with reference to the accompanying drawings so that the present disclosure may be easily realized by those skilled in the art.

However, the present disclosure may be achieved in various different forms and is not limited to the embodiments described herein. In the drawings, parts that are not related to a description of the present disclosure are omitted to clearly explain the present disclosure and similar reference numbers will be used throughout this specification to refer to similar parts.

In the present specification, redundant descriptions of the same components are omitted.

It will be understood that, when an element is referred to as being "connected to" another element, the element can be connected to the other element or intervening elements may also be present. In contrast, when an element is referred to as being "directly connected to" another element, there are no intervening elements present.

Specific terminology used in this specification is only for convenience of description and is not intended to be limiting of the illustrative embodiments.

A singular representation may include a plural representation unless it represents a definitely different meaning from the context.

In description of the present disclosure, the terms "comprising," "including," and "having" shall be understood to designate the presence of particular features, numbers, steps, operations, elements, parts, or combinations thereof, but not to preclude the presence or addition of one or more other features, numbers, steps, operations, elements, parts, or combinations thereof.

In description of the present disclosure, the term "and/or" may include a combination of a plurality of items or any one of a plurality of listed items. For example, "A or B" may include "only A", "only B", and/or "both A and B".

FIG. 1 is a perspective view illustrating an exterior appearance of a laundry treatment apparatus 1 according to an embodiment of the present disclosure. Referring to FIG. 1, the laundry treatment apparatus 1 may include a cabinet 10.

The cabinet 10 may form the exterior appearance of the laundry treatment apparatus 1, and may have a space in which a drum 30 and a tub 20, which will be described later, are provided. Although FIG. 1 shows the cabinet 10 formed in a hexahedral shape, the scope or spirit of the present disclosure is not limited thereto, and it should be noted that the cabinet 10 can be implemented in various shapes.

The cabinet 10 may include a plurality of panels. The plurality of panels may include a front panel 15, a side panel, an upper panel, a lower panel, and a rear panel. The plurality of panels may be coupled to each other to form the cabinet 10.

A detergent opening 16 and a laundry opening 17 may be formed in the front panel 15. The detergent opening 16 may correspond to a passage through which the storage unit 140 of the detergent supply device 100 moves, and the laundry opening 17 may correspond to a passage through which the user puts laundry into the drum 30 inside the cabinet 10.

That is, according to one embodiment of the present disclosure, the cabinet 10 may include a front panel 15 in which a detergent opening 16 is formed.

In one embodiment of the present disclosure, the expression "forward" or "front" may refer to the direction in which the front panel 15 is located based on the cabinet 10, and the front panel 15 may correspond to the panel in which the detergent opening 16 is formed. That is, according to the present disclosure, the direction in which the detergent opening 16 is located based on the cabinet 10 may be defined as a forward direction.

The front panel 15 may include a laundry door 40 for opening/closing the laundry opening 17, and an operation unit 50 for allowing a user to operate the laundry treatment apparatus 1. However, the operation unit 50 may be provided at various positions, such as the upper panel or the side panel as needed.

The laundry door 40 may be hinged to the outside of the front panel 15 so that the laundry door 40 can rotate. The laundry opening 17 of the front panel 15 may be opened or closed by the laundry door 40.

The operation unit 50 may include a screen output unit 55 for delivering information to the user. The operation unit 50 may include a button unit 53 through which the user can input a signal, and a dial 56. A detailed description of the operation unit 50 will be given later.

The laundry treatment apparatus according to one embodiment of the present disclosure may include a controller, and the controller may be electrically and signally connected to the operation unit 50. In addition, the controller may be electrically and signally connected to an object that requires electrical/electronic control, such as a drive unit for rotating the drum 30 or a water supply unit for supplying water.

The controller may receive signals to be input to the operation unit 50 by the user, and may control each of the constituent components of the laundry treatment apparatus 1 based on the transmitted signals. In addition, the operation states, etc. of the laundry treatment apparatus 1 may be transmitted to the user through the operation unit 50 based on the signals transmitted from each of the above components.

Meanwhile, the laundry treatment apparatus according to one embodiment of the present disclosure may include a drum 30 and a tub 20. The tub 20 may be provided inside the cabinet 10, and may accommodate water therein. The drum 30 may be rotatably provided inside the tub 20, and may accommodate laundry therein.

The drum 30 may include a plurality of communication holes formed on the outer circumferential surface thereof so that the inside of the drum 30 can communicate with the tub 20 through the plurality of communication holes. Accordingly, water stored in the tub 20 may be supplied to the inside of the drum 30 and then supplied to the laundry placed in the drum 30.

On the other hand, the laundry treatment apparatus according to one embodiment of the present disclosure may include a detergent supply device 100. The detergent supply device 100 may be provided inside the cabinet 10, or may be provided outside the cabinet 10 so that detergent can be supplied into the tub 20 or the drum 30.

According to the present disclosure, detergents may include not only a laundry detergent for removing foreign substances from laundry, but also a softener for improving flexibility of fibers and a bleaching agent for color safe bleach for brightening colors of fibers. In addition, the detergent may be defined to include various shapes and types, such as powdered detergents as well as liquid detergents.

The detergent supply device 100 may include a storage unit 140 in which detergent is stored, and the storage unit 140 may be introduced into or taken out of the cabinet 10 through the detergent opening 16 of the front panel 15. A detailed description of the detergent supply device 100 will be given later.

Figure 2:
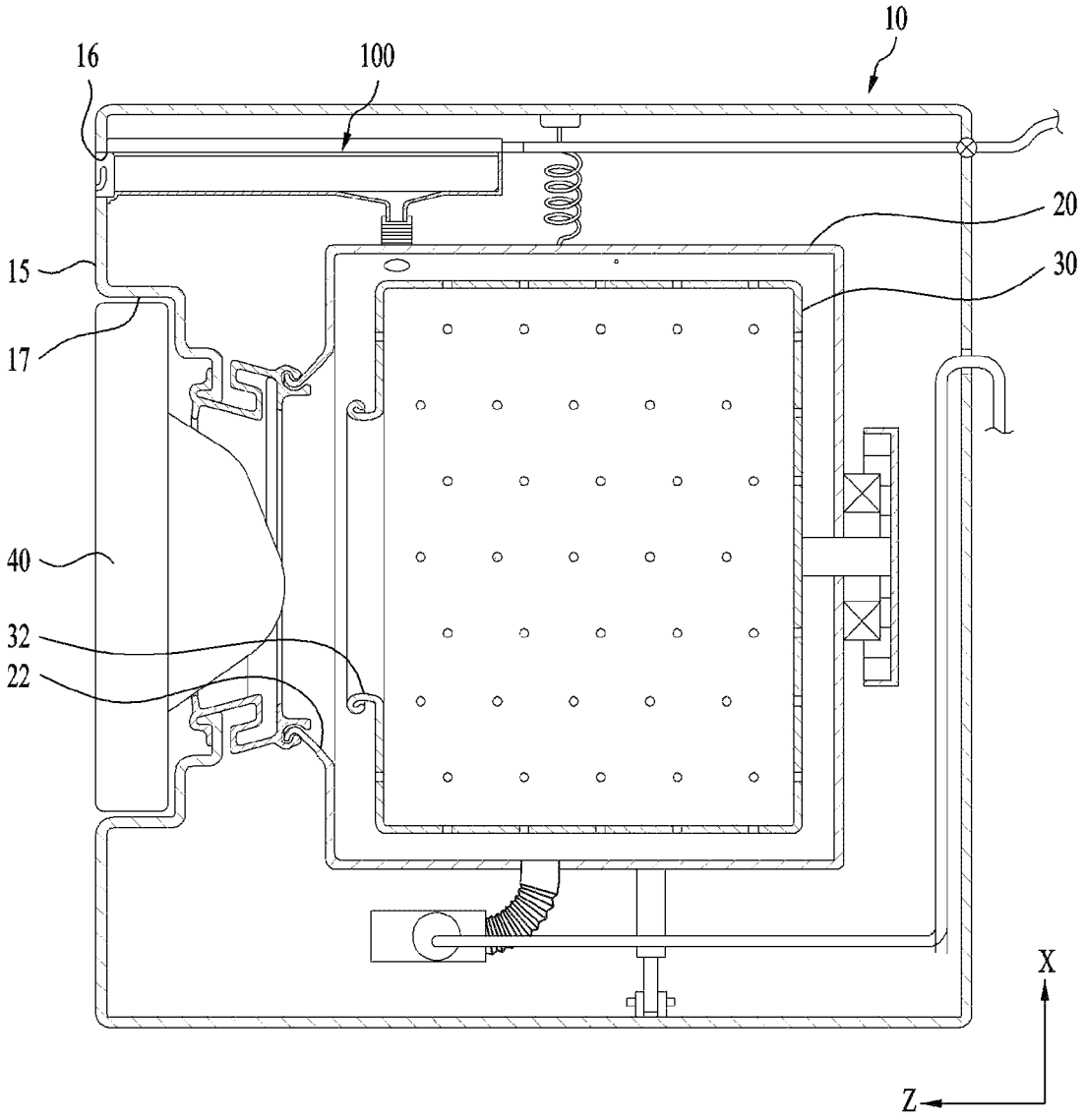
FIG. 2 is a cross-sectional view illustrating the laundry treatment apparatus according to an embodiment of the present disclosure.

FIG. 2 is a cross-sectional view illustrating internal constituent components of the laundry treatment apparatus 1 according to an embodiment of the present disclosure. The internal constituent elements of the laundry treatment apparatus 1 according to an embodiment of the present disclosure will be schematically described with reference to FIG. 2.

The laundry opening 17 of the front panel 15 may be shielded by the laundry door 40, and when the user wishes to wash laundry, the laundry opening 17 may be opened by the laundry door 40 operated by the user.

Laundry may be put into the opened laundry opening 17, and the laundry put into the drum through the laundry opening 17 may be introduced into the drum 30 through a tub opening 22 of the tub 20 and a drum opening 32 of the drum 30.

The tub 20 may be fixed inside the cabinet 10, and the front surface facing the laundry opening 17 may be opened to form the tub opening 22. The tub 20 may be connected to the front panel 15 through a gasket that prevents laundry from leaving the drum 30 and prevents water leakage. In addition, the tub 20 may be supported on the cabinet 10 through a damper to minimize transfer of vibration to the cabinet 10.

The drum 30 may be disposed inside the tub 20. In the drum 30, the front surface facing both the tub opening 22 and the laundry opening 17 may be opened to form the drum opening 32. That is, the laundry opening 17, the tub opening 22, and the drum opening 32 may be aligned in parallel to communicate with each other.

As described above, the drum 30 may have a plurality of communication holes formed on the outer circumferential surface thereof so that water stored in the tub 20 can be provided into the drum 30. In addition, the drum 30 may have a rotary shaft so that the drum 30 can rotate.

The drum 30 may be connected to the drive unit through a rotary shaft. The drive unit may provide rotational force based on a signal output from the controller, and the rotational force of the drive unit may be transmitted to the drum 30 through the rotary shaft to rotate the drum 30.

Although the embodiment of the present disclosure has disclosed a front-loader type laundry treatment apparatus in which the rotary shaft of the drum 30 extends in the forward and backward directions and the laundry opening 17 is provided in the front panel 15 as shown in FIG. 2, the scope or spirit of the present disclosure is not limited thereto, and it should be noted that the laundry treatment apparatus may also be implemented as a top-loading type laundry treatment apparatus in which the laundry opening 17 is formed in the upper panel. However, unless otherwise stated, the following description will be given based on the front-loading type laundry treatment apparatus.

Meanwhile, the laundry treatment apparatus 1 according to the embodiment of the present disclosure may be connected to an external water supply source to receive water. A water supply unit connected to the external water supply source may be provided inside the cabinet 10.

The water supply unit may include a water supply valve, and the controller may supply water into the tub 20 during a washing process, etc. through control of the water supply valve. The water supply unit may be provided to supply water into the tub 20 through the detergent supply device 100 or may be provided to directly supply water into the tub 20 separately from the detergent supply device 100.

The detergent supply device 100 may be connected to the water supply unit through a water hose. That is, the detergent supply device 100 may be provided to receive water from the water supply unit and to supply both detergent and water into the tub 20 or the drum 30.

The laundry treatment apparatus 1 according to the embodiment of the present disclosure may include a drain unit connected to the tub 20. The drain unit may be provided to discharge water contained in the tub 20 to the outside.

Figure 3:
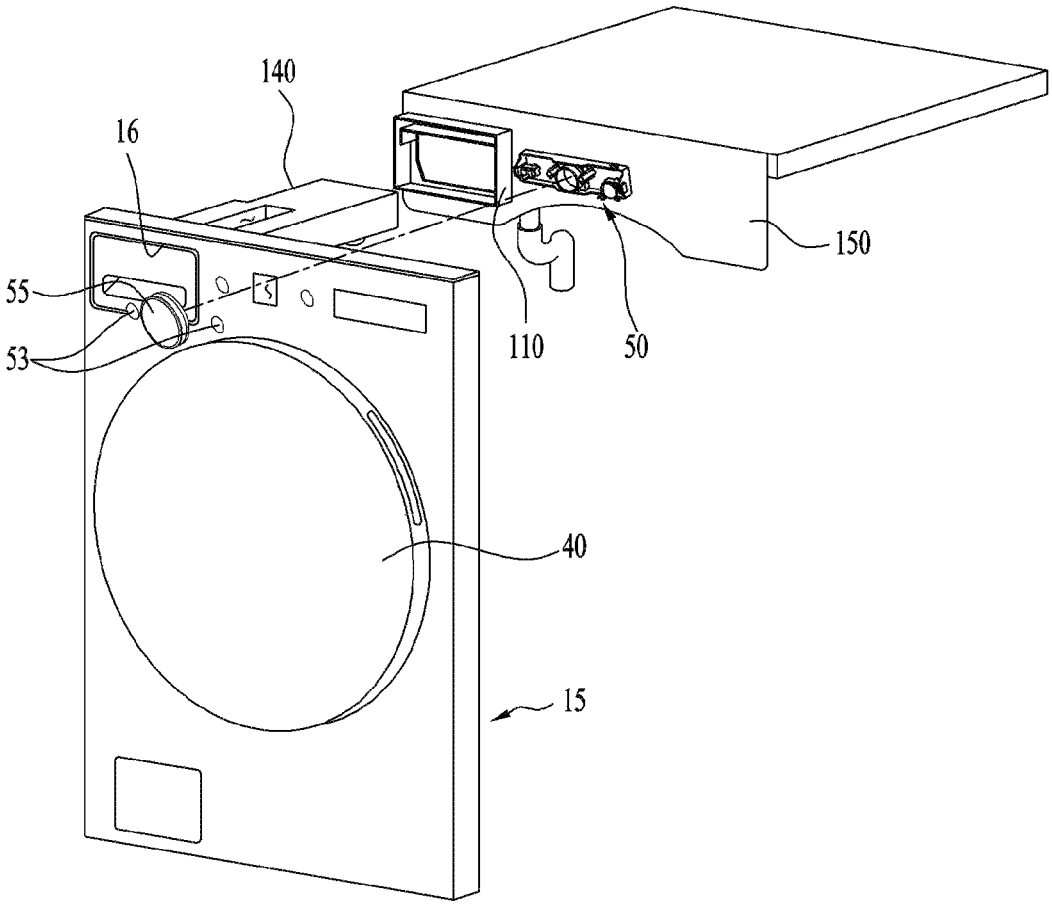
FIG. 3 is an exploded perspective view illustrating a front panel and a panel reinforcement unit separated from each other in the laundry treatment apparatus according to an embodiment of the present disclosure.

Meanwhile, FIG. 3 shows the appearance of the front panel 15 separated from the cabinet 10. A detailed configuration of the front panel 15 will be explained below with reference to FIG. 3.

As described above, the front panel 15 may be provided with a laundry opening 17 and a detergent opening 16. The laundry opening 17 may be opened and closed by the laundry door 40, and the storage unit 140 of the detergent supply device 100 may be inserted into the detergent opening 16.

As will be described later, the storage unit 140 may be provided with a handle 143 that can be gripped by a user at the front end thereof, and when the storage unit 140 is introduced into the cabinet 10, a front surface of the handle 143 may form the front surface of the laundry treatment apparatus 1 together with the front panel 15.

A panel reinforcement unit 150 capable of improving the rigidity of the front panel 15 and allowing the operation unit 50 and the detergent supply unit 100 to be fixed thereto may be provided at the rear side of the front panel 15. The panel reinforcement unit 150 may be coupled to the front panel 15 or may be coupled to the upper panel and the side panel.

The panel reinforcement unit 150 may be provided in a plate shape extending along the width direction of the cabinet 10. The panel reinforcement unit 150 may correspond to a plate provided parallel to the front surface of the cabinet 10. The panel reinforcement unit 150 may be disposed on the upper side of the front panel 15, and at least a portion of the detergent supply device 100 and the operation unit 50 may be coupled to the panel reinforcement unit 150.

The panel reinforcement unit 150 may be coupled to a panel flange 18 of the front panel 15. The panel flange 18 may be formed in a flange shape extending rearward from the edge of the front panel 15, and the panel reinforcement unit 150 may be coupled to the upper side of the panel flange 18.

In addition, the upper side of the panel flange 18 may have an additional extension unit extending downward from the rear end, and the panel reinforcement unit 150 may be coupled to the additional extension unit.

Meanwhile, the operation unit 50 may be coupled to the panel reinforcement unit 150. The operation unit 50 may include a screen output unit 55 for providing visual information to the user, and a button unit 53 and dial 56 for generating input signals through manipulation by the user.

The front panel 15 may include an opening formed such that the screen output unit 55, the button unit 53, the dial 56, etc. can be exposed to the user. The screen output unit 55, the button unit 53, the dial 56, etc. may be connected to the panel reinforcement unit 150 through the above opening. The dial 56 may be included in the screen output unit 55 as will be described later.

Figure 4:
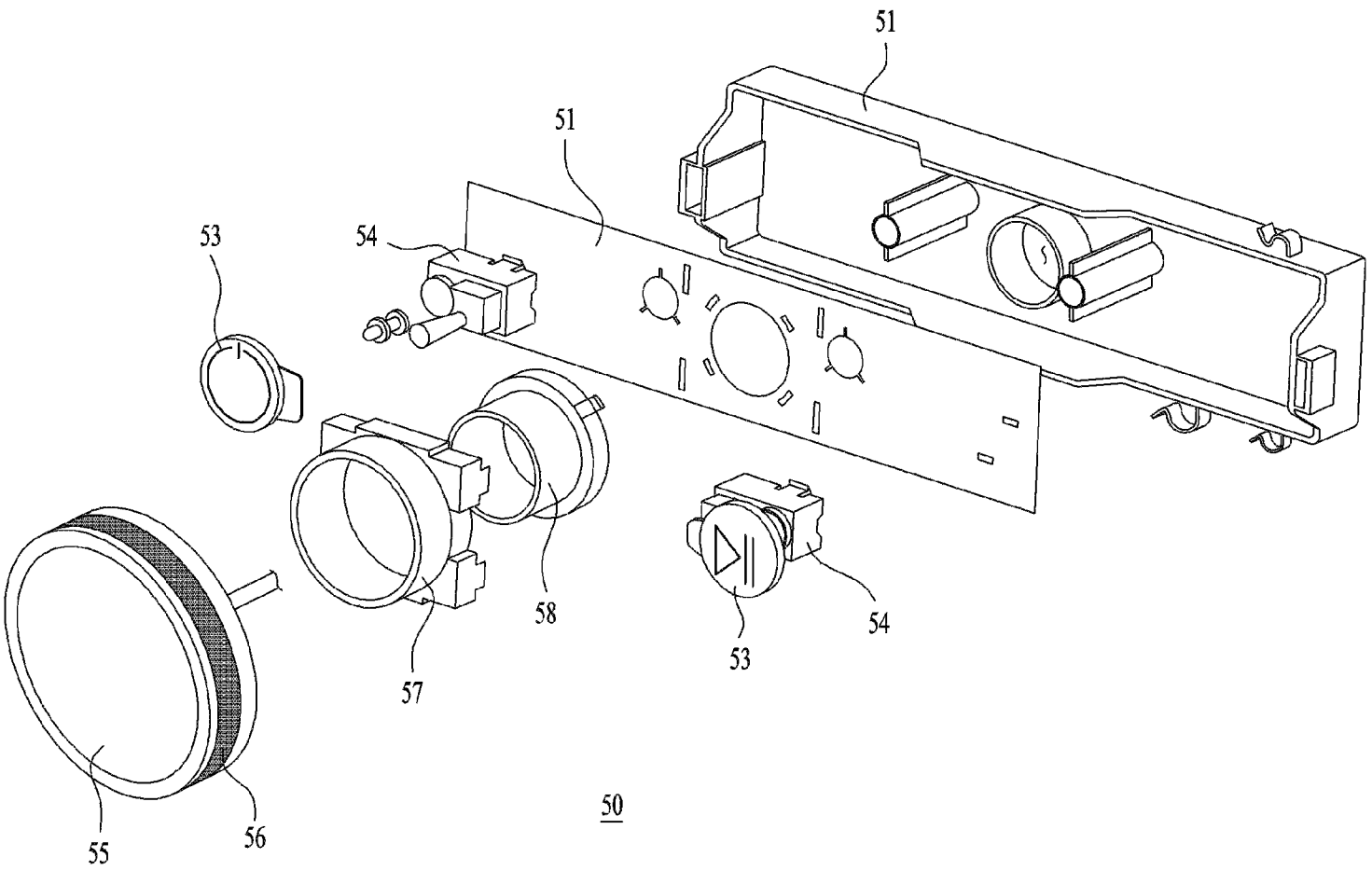
FIG. 4 is an exploded view illustrating an operation unit of the laundry treatment apparatus according to an embodiment of the present disclosure.

Meanwhile, FIG. 4 is an exploded view illustrating the operation unit 50 according to the embodiment of the present disclosure. A detailed configuration of the operation unit 50 will be schematically described with reference to FIG. 4.

The operation unit 50 may be provided inside the front panel 15. That is, the operation unit 50 may be disposed between the front surface of the cabinet 10 and the panel reinforcement unit 150. The inside of the front panel 15 may refer to the area surrounded by the front surface of the front panel 15 and the panel flange 18.

The interior of the front panel 15 may be disposed behind the front surface of the front panel 15, and may be opened rearward. The interior of the front panel 15 may be located at the front side of the upper panel, the side panel, and the lower panel.

The operation unit 50 may be coupled to the front surface of the panel reinforcement unit 150, so that the operation unit 50 may be disposed in the front panel 15. The operation unit 50 may include an operation housing 51 coupled to the panel reinforcement unit 150. The operation housing 51 may include a substrate 52 electrically connected to the button unit 53, the dial 56, and the screen output unit 55.

The substrate 52 may be provided inside the operation housing 51 and may be connected to the button unit 53 and the screen output unit 55. The interior of the operation housing 51 may be filled with a sealer to ensure watertightness after the substrate 52 is accommodated in the operation unit 50.

Meanwhile, the button unit 53 may include a button housing 54 coupled to the substrate 52. The button housing 54 may be coupled or connected to the substrate 52 in various ways and may include a button exposed to the front of the front panel 15.

The button unit 53 may generate a user's input signal by detecting physical force or electrical force generated by the user. For example, the button unit 53 may be a mechanical-type button designed to physically move, or a touch-type button that does not physically move but detects user's contact.

The button unit 53 may be provided to generate an electric signal when pressed by the user, or to generate an electric signal to be transmitted to the controller when electric force is input by contact with the user's hand.

Meanwhile, a plurality of button units 53 may be provided. FIG. 4 shows two button units 53 provided in the operation unit 50, but the number of button units 53 may vary as needed. FIG. 4 shows the plurality of button units 53 including a power button unit 53 and a start button unit 53.

The operation unit 50 may include a screen output unit 55, and the screen output unit 55 may include a dial 56. In addition, the screen output unit 55 may include an output housing 57 coupled to the substrate 52, and may include a rotation detection unit 58 for detecting rotation of the dial 56.

The screen output unit 55 may provide the user with an output screen corresponding to the output signal transmitted by the controller. At least a portion of the screen output unit 55 may correspond to a touch area that can receive a user's touch signal. The dial 56 may be provided to surround the screen output unit 55, and the user may transmit an input signal to the controller by rotating the dial 56 of the screen output unit 55.

The rotation detection unit 58 may be provided inside the output housing 57, and may be connected to the dial 56 to detect rotation of the dial 56. The rotation detection unit 58 may correspond to an encoder that includes a magnetic force generator and is equipped with a fixed body and a rotary body.

A rotary body of the rotation detection unit 58 may be connected to the dial 56 and can rotate together with the dial 56. When the user rotates the dial 56, the rotation detection unit 58 may generate an electrical signal by rotation of the rotary body, and may transmit the electrical signal to the controller.

According to one embodiment of the present disclosure, the operation unit 50 may be provided inside the front panel 15, and thus the front panel 15 may have a sufficient length to enable the operation unit 50 to be accommodated in the forward and backward directions. For example, the rearward extension length of the panel flange 18 of the front panel 15 may be longer than a front-to-back length of the operation unit 50.

Figure 5:
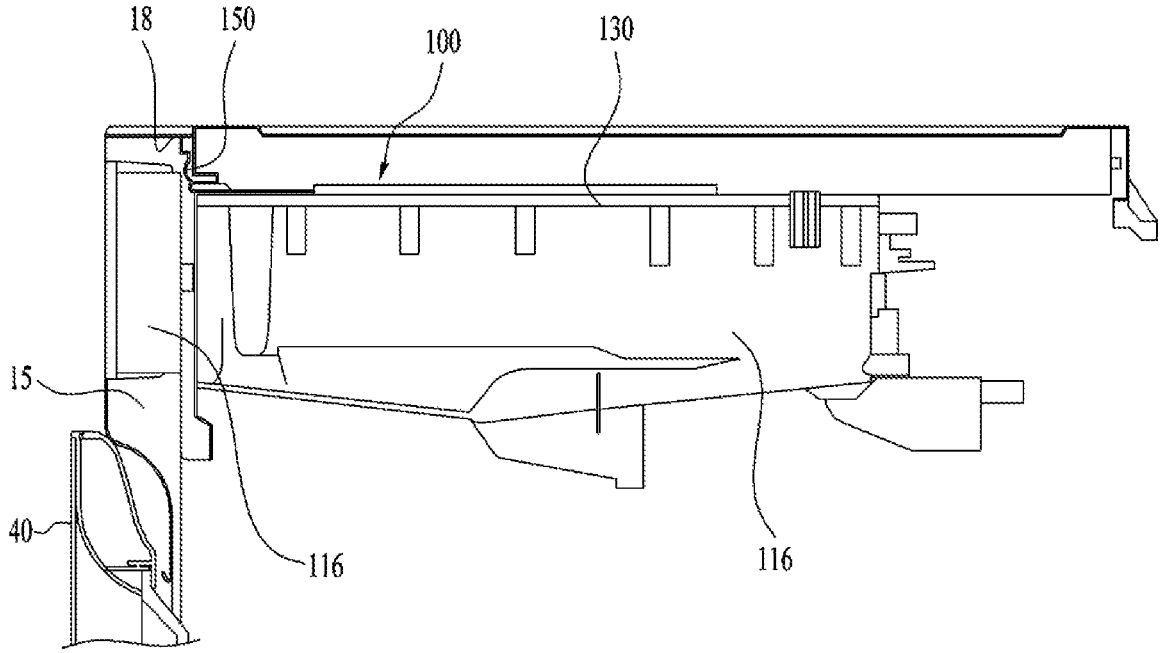
FIG. 5 is a diagram showing a detergent supply device located inside a cabinet of the laundry treatment apparatus according to an embodiment of the present disclosure.

Meanwhile, FIG. 5 shows a side view of the detergent supply device 100 provided inside the cabinet 10 according to the embodiment of the present disclosure. As shown in FIG. 5, the detergent supply device 100 may be provided to be connected to the detergent opening 16 located inside the cabinet 10.

Specifically, the detergent supply device 100 may be disposed at the rear side of the detergent opening 16 of the front panel 15. Accordingly, the storage unit 140 can be introduced through the detergent opening 16 and accommodated inside the supply case of the detergent supply device 100.

The detergent supply device 100 may include a supply case to accommodate the storage unit 140 to be inserted into the cabinet 10. The supply case may include a front case 110, a lower case 120, and an upper case 130. The front case 110, the lower case 120, and the upper case 130 may form a supply case together.

Figure 6:
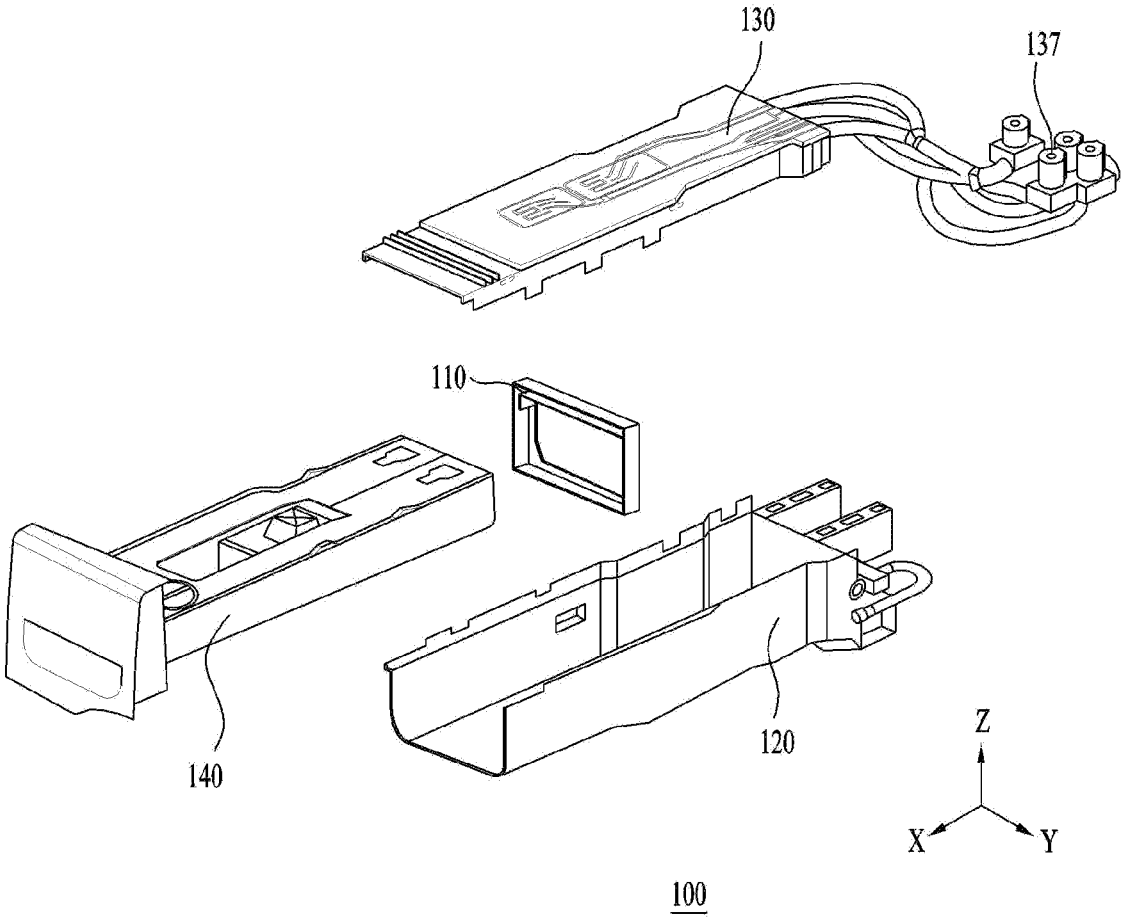
FIG. 6 is an exploded view illustrating the detergent supply device of the laundry treatment apparatus according to an embodiment of the present disclosure.

Meanwhile, FIG. 6 shows an exploded view of the detergent supply device 100 of the laundry treatment apparatus 1 according to the embodiment of the present disclosure. The constituent components of the detergent supply device 100 will be schematically described with reference to FIG. 6.

The detergent supply device 100 may include a storage unit 140 and a supply case. As described above, the storage unit 140 can be moved into and out of the cabinet 10 through the detergent opening 16, and detergent can be stored in the storage unit 140 by the user.

The supply case may be provided inside the cabinet 10, and the storage unit 140 introduced into the cabinet 10 may be accommodated therein. The supply case may be formed in a shape in which one surface facing the detergent opening 16 is open.

The supply case may include a front case 110, a lower case 120, and an upper case 130. The front case 110 may be disposed at the front side of the supply case, and the lower case 120 and upper case 130 may be disposed at the rear side of the front case 110.

The front case 110 may be disposed at the rear side of the detergent opening 16. The front case 110 may be disposed behind the detergent opening 16 within the front panel 15, and may be penetrated by the storage unit 140. That is, the front case 110 may be provided to surround the front end of the storage unit 140 introduced into the cabinet 10.

The lower case 120 may be provided to accommodate the storage unit 140 at the rear side of the front case 110. The lower case 120 may be provided in a box shape having the opened front surface facing the detergent opening 16 and the opened upper surface facing the upper case 130.

The lower case 120 may be coupled to the front case 110 or the panel reinforcement unit 150 at the rear side of the front case 110. That is, the panel reinforcement unit 150 may be located between the front case 110 and the lower case 120. The panel reinforcement unit 150 may be penetrated by the storage unit 140.

The upper case 130 may be located above the lower case 120 at the rear side of the front case 110. The upper case 130 may be coupled to the lower case 120 to shield the opened upper surface of the lower case 120. That is, the upper case 130 may be provided to cover the upper surface of the storage unit 140 inserted into the cabinet 10.

Meanwhile, the upper case 130 may be connected to a water supply portion. In other words, the upper case 130 may correspond to a water supply unit that supplies water received from the water supply portion to both the inside of the lower case 120 and the storage unit 140.

As described above, the water supply unit may be connected to a water supply source located outside the cabinet 10, and may deliver water to the upper case 130 through a plurality of water supply valves and water hoses. The water delivered to the upper case 130 may be supplied to the inside of the lower case 120 and the storage unit 140. The lower case 120 may discharge water and detergent toward the tub 20 through a drain hole 122, which will be described later.

Figure 7:
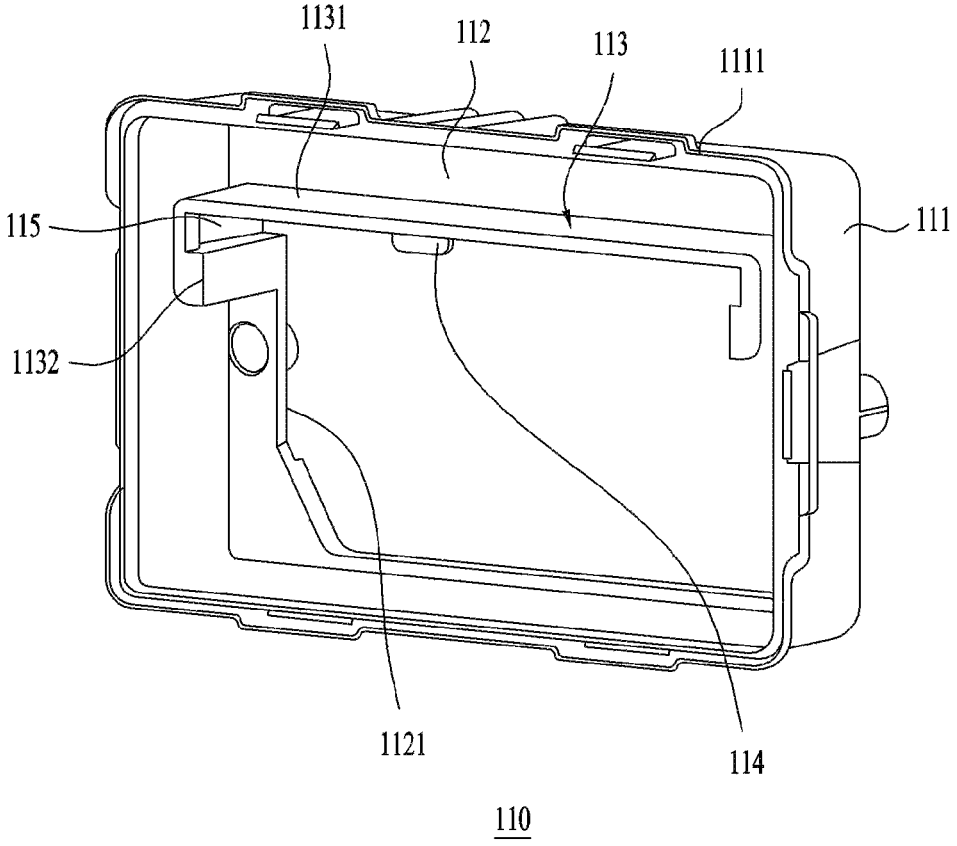
FIG. 7 is a diagram illustrating a front case of the detergent supply device in the laundry treatment apparatus according to an embodiment of the present disclosure.
Figure 8:
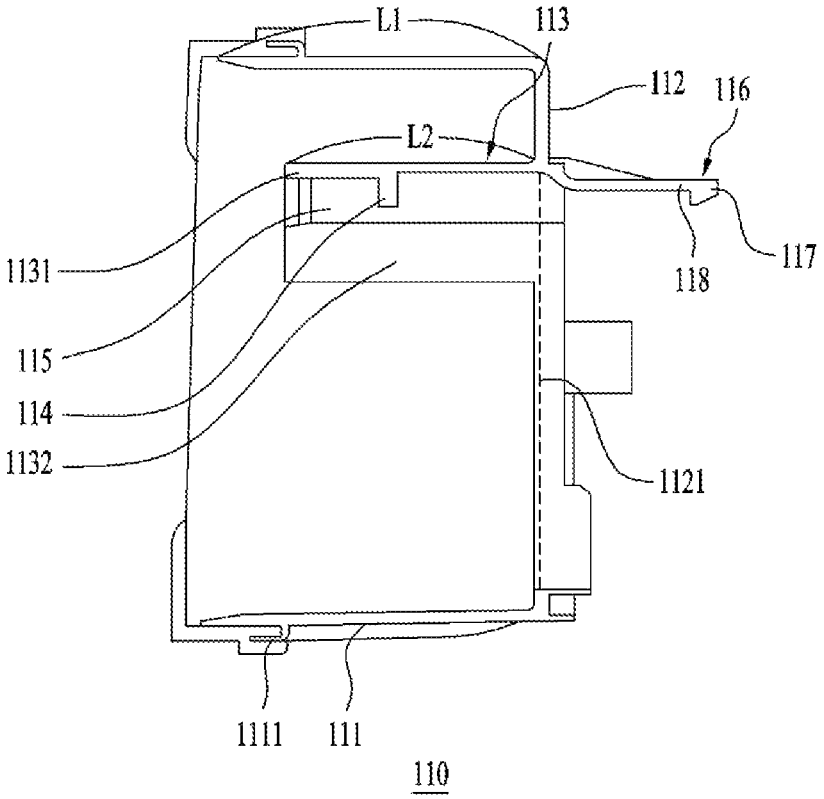
FIG. 8 is a cross-sectional view illustrating the front case of the laundry treatment apparatus according to an embodiment of the present disclosure.

Meanwhile, FIG. 7 shows the front case 110 of the detergent supply device 100 according to the embodiment of the present disclosure, and FIG. 8 is a cross-sectional view of the front case 110 when viewed from the side.

First, as described above, the laundry treatment apparatus 1 according to the embodiment of the present disclosure may include the cabinet 10, the tub 20, the drum 30, and the detergent supply device 100. The cabinet 10 may include the front panel 15 in which a detergent opening 16 is formed.

The tub 20 may be provided inside the cabinet 10, and may accommodate water. The drum 30 may be rotatably provided inside the tub 20, and may accommodate laundry. The detergent supply device 100 may be provided in the cabinet 10, and may supply detergent into the tub 20 or drum 30.

The detergent supply device 100 may include the storage unit 140 and the front case 110. The storage unit 140 may store detergent, and may be introduced into or taken out of the cabinet 10 through the detergent opening 16.

The front case 110 may be located at a rear side of the detergent opening 16, may accommodate a portion of the storage unit 140, and may include a rear wall 112 formed to be penetrated by the remainder of the storage unit 140.

Meanwhile, the front case 110 may include a stopper 114, and the stopper 114 may be located at a front side of the rear wall 112, may protrude toward the storage unit 140 to restrict the withdrawal distance of the storage unit 140 inserted into the cabinet 10.

Referring to FIGS. 7 and 8, the front case 110 may be located at a rear side of the detergent opening 16, and may accommodate a portion of the storage unit 140. The detergent opening 16 may be provided in the front panel 15, and the storage unit 140 may be introduced into the cabinet 10 through the detergent opening 16 so that the front case 110 can accommodate the front end of the storage unit 140.

For example, the storage unit 140 may be provided with a handle 143 located at the front side as described above, and the front end of the storage unit 140 may include the handle 143. That is, the handle 143 may be accommodated in the front case 110 in a state where the storage unit 140 is completely inserted into the cabinet 10, and the front surface of the storage unit 140 may form the front surface of the cabinet 10 together with the front panel 15.

Meanwhile, the front case 110 may include a rear wall 112. The rear wall 112 may be spaced rearward from the detergent opening 16, and may be provided to support the front end of the storage unit 140 at the rear side of the storage unit 140.

The storage unit 140 may be configured such that a front end capable of being in correspondence with the handle 143 is accommodated in the front case 110, and the remaining portions of the storage unit 140 penetrates the rear wall 112 of the front case 110 to enter the lower case 120.

Meanwhile, the front case 110 may include a stopper 114. The stopper 114 may be located at a front side of the rear wall 112 in the front case 110, and may protrude toward the storage unit 140 to restrict the withdrawal distance of the storage unit 140 inserted into the cabinet 10.

According to one embodiment of the present disclosure, the storage unit 140 may be pulled out from or be inserted into the cabinet 10 by the user, and when the user withdraws the storage unit 140 from the cabinet 10, maintenance of the storage unit 140 may be performed or the storage unit 140 may be re-inserted into the cabinet 10 after replenishing detergent in the storage unit 140.

However, during normal use of the laundry treatment apparatus 1 according to the embodiment of the present disclosure, the user generally withdraws the storage unit 140 from the cabinet 10 to replenish detergent in the storage unit 140. In this case, when the storage unit 140 is completely pulled out from the cabinet 10, the user must temporarily support or store the storage unit 140 at the outside of the cabinet 10 and must allow the storage unit 140 to be inserted into the cabinet 10 through the detergent opening 16, resulting in inconvenience of use.

Accordingly, according to one embodiment of the present disclosure, the front case 110 may be provided with the stopper 114. As a result, when the storage unit completely inserted into the cabinet 10 is pulled out, a maximum distance by which the storage unit 140 can be pulled out from the cabinet 10 can be restricted.

Accordingly, even when the storage unit 140 is pulled out from the cabinet 10 by the user, the user can easily replenish detergent in the storage unit 140 fixed to the cabinet 10, resulting in convenience of use. As a result, inconvenience of the user who must arrange the storage unit 140 and the detergent opening 16 and must enable the storage unit 140 to be inserted into the cabinet 10 can be effectively addressed.

The stopper 114 may protrude toward the storage unit 140, and may restrict the withdrawal distance of the storage unit 140 through physical interference with the storage unit 140.

For example, the stopper 114 may be provided on the front case 110 to protrude toward the storage unit 140, and may be arranged to overlap a portion of the storage unit 140 completely inserted into the cabinet 10 in the front-to-back direction.

That is, the stopper 114 may be located in front of some components of the storage unit 140 inserted into the cabinet 10, and the storage unit 140 may contact the stopper 114 during the withdrawal process of the above some components of the storage unit 140 so that the storage unit 140 may not move forward and the withdrawal distance of the storage unit 140 may be restricted.

A portion contacting the stopper 114 in the storage unit 140 may be determined in various ways. For example, the stopper 114 may be located in front of the outer wall, protrusion, or other configuration of the storage unit 140.

In a state in which the storage unit 140 is completely inserted into the cabinet 10, a separation distance between the stopper 114 and a portion located at a rear side of the stopper 114 in the storage unit 140 may correspond to a withdrawal restriction distance determined by designs according to one embodiment of the present disclosure.

Meanwhile, as will be described later, the user may easily overcome the withdrawal distance restriction of the storage unit 140 by manipulating the withdrawal restriction bar 146 provided in the storage unit 140, and may completely withdraw the storage unit 140 from the cabinet 10.

According to the embodiment of the present disclosure, the stopper 114 may be located in front of the rear wall 112. That is, the stopper 114 may be disposed between the detergent opening 16 and the rear wall 112. Accordingly, the embodiment of the present disclosure can effectively increase the withdrawal restriction distance of the storage unit 140. Here, the withdrawal restriction distance may be preset by design of the stopper 114. The withdrawal restriction distance may refer to a maximum withdrawal distance at which movement of the storage unit 140 inserted into the cabinet 10 is restricted by the stopper 114.

As described above, the laundry treatment apparatus 1 according to the embodiment of the present disclosure may be provided with various configurations located inside the front panel 15 to improve user convenience or to be advantageous in design in terms of space utilization.

Meanwhile, in order for components such as the above-described operation unit 50 to be easily provided inside the front panel 15, sufficient space within the front panel 15 needs to be secured. For example, the front panel 15 may be configured to have the panel flange 18 of a sufficient length so that the constituent components such as the operation unit or the like can be disposed in the front panel 15.

However, when the length of the front panel 15 is increased as described above, the withdrawal length of the storage unit 140 for which the withdrawal restriction distance is preset may be reduced in the direction from the inside of the cabinet 10 to the outside of the cabinet 10.

For example, when the length of the panel flange 18 increases in consideration of the arrangement structure between various components, the position of the detergent supply device 100 disposed in the cabinet 10 is fixed. As a result, in a state in which the storage unit 140, the withdrawal restriction distance of which is determined based on the detergent supply device 100, is pulled out by the withdrawal restriction distance, the length of the storage unit, which is exposed to the outside of the cabinet 10, may be reduced as the length of the panel flange 18 increases.

The storage unit 140 must be set to be conveniently used by the user even when the storage unit 140 is withdrawn by the withdrawal restriction distance. For example, even if the storage unit 140 is withdrawn from the cabinet 10 by the withdrawal restriction distance, the configuration for replenishing detergent needs to be sufficiently exposed to the outside of the cabinet 10, and the withdrawal restriction bar 146, which will be described later, should be exposed to the outside so that the user can directly determine whether to restrict the withdrawal of the storage unit 140.

That is, in the laundry treatment apparatus 1, a thickness of the front panel 15 in the forward and backward directions of the front panel 15 may be increased due to various design reasons such as the configuration disposed in the front panel 15. Accordingly, the withdrawal restriction distance of the storage unit 140 in response to such increasing thickness of the front panel 15 needs to be increased to ensure sufficient ease of usage of the storage unit 140.

However, when increasing the length of the storage unit 140 to increase the withdrawal restriction distance, the entire length of the detergent supply device 100 needs to be increased along with the storage unit 140, which may be disadvantageous in design.

In addition, when the stopper 114 is located in the lower case 120 or the upper case 130, the stopper 114 may not be located farther forward than the front end of the upper case 130, there may occur restrictions in increasing the withdrawal restriction distance of the storage unit 140.

Furthermore, when the stopper 114 is disposed on the rear wall 112 while being provided in the front case 110, a difference in distance between the front end of the upper case 130 and the stopper 114 is very small, so that there may occur restrictions in increasing the withdrawal restriction distance of the storage unit 140.

Accordingly, in the laundry treatment apparatus according to one embodiment of the present disclosure, the front case 110 may be provided with the stopper 114, and the stopper 114 may be located farther forward than the rear wall 112. As a result, the withdrawal restriction distance of the storage unit 140, which is set as physical interference by the stopper 114, may be maximized, thereby preventing inconvenience of the user who uses the storage unit 140 even if the length of the front panel 15 in the forward and backward directions increases.

In addition, since the laundry treatment apparatus according to the embodiment of the present disclosure is provided with the stopper 114, a design change for changing the position of the stopper 114 may be simple and the degree of design change of other configurations such as the storage unit 140 or the upper case 130, etc. may be minimized.

Meanwhile, as shown in FIGS. 7 and 8, according to one embodiment of the present disclosure, the front case 110 may further include an opening circumferential wall 111 and a front extension unit 113. The opening circumferential wall 111 may be located at the rear side of the detergent opening 16, and the rear wall 112 may be connected to the rear end of the front case 110, and may extend along the circumference of the rear wall 112.

The front extension unit 113 may extend forward from the rear wall 112, and the stopper 114 may be provided at the front extension unit 113 and may protrude toward the storage unit 140.

Specifically, the opening circumferential wall 111 may form a closed curve extending in the circumferential direction of the detergent opening 16, and may be connected to the detergent opening 16 at the rear end of the front case 110. That is, according to one embodiment of the present disclosure, the front case 110 may be provided in a box shape that includes an opened front surface and a back surface having through-holes 1121.

The opening circumferential wall 111 may be coupled to the front panel 15 at the rear side of the detergent opening. The front panel 15 may include an opening flange extending rearward from the circumference of the detergent opening 16, and the opening circumferential wall 111 may include an opening coupling unit 1111 for coupling to the opening flange.

The opening circumferential wall 111 may extend along the circumference of the rear wall 112, and may extend from the circumference of the rear wall 112 toward the detergent opening 16. The opening coupling unit 1111 may be provided to protrude outward from the opening circumferential wall 111, and the opening flange may be inserted into the opening coupling unit 1111 to form a coupling relationship.

Meanwhile, the front extension unit 113 may extend forward from the rear wall 112. That is, the front extension unit 113 may extend forward from the rear wall 112 at the inside of the front case 110. The front extension unit 113 may be provided to be spaced apart from the opening circumferential wall 111.

The front extension unit 113 may have a shape extending to surround at least a portion of the circumference of the through hole 1121 penetrated by the storage unit 140 in the rear wall 112, and the stopper 114 may be provided in the front extension unit 113 and may protrude toward the storage unit 140.

The front extension unit 113 may be spaced apart from the opening circumferential wall 111, and may be located closer to the storage unit 140 than the opening circumferential wall 111. As described above, according to one embodiment of the present disclosure, the stopper 114 may be located farther forward than the rear wall 112 in the front case 110. When the stopper 114 protrudes from the opening circumferential wall 111, the stopper 114 (114) must have a protruding length equal to a separation distance between the opening circumferential wall 111 and the storage unit 140, which may be disadvantageous in securing rigidity.

According to one embodiment of the present disclosure, the front extension unit 113 may be disposed in the front case 110 surrounded by the opening circumferential wall 111, thereby ensuring structural stability while minimizing a protruding length of the stopper 114. As a result, the position of the stopper 114 can be effectively set to the front side of the rear wall 112.

Meanwhile, according to the embodiment of the present disclosure, a sliding protrusion 142 may be provided at the sidewall of the storage unit 140, and the sliding protrusion 142 may extend in the movement direction of the storage unit 140.

A sliding groove 115 extending in the movement direction and allowing the sliding protrusion 142 to slide therein may be provided at a portion of the front extension unit 113 facing the sliding protrusion 142.

Figure 11:
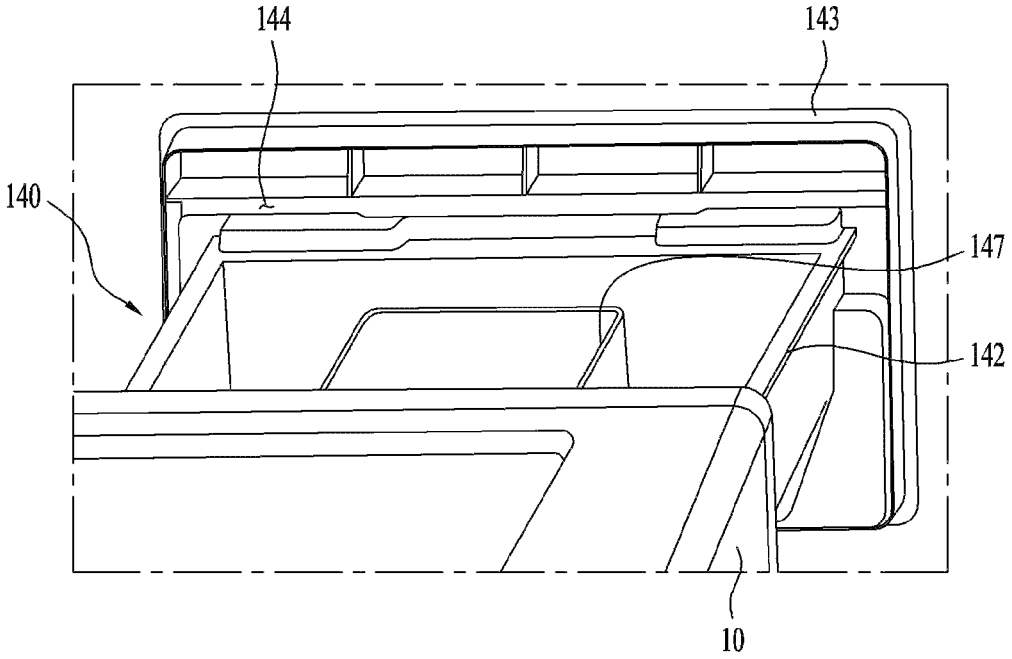
FIG. 11 is a rear view illustrating the storage unit pulled out from the cabinet in the laundry treatment apparatus according to an embodiment of the present disclosure as seen from the rear.

According to one embodiment of the present disclosure, the storage unit 140 may move in a sliding manner within the supply case. In the storage unit 140, sliding protrusions 142 may be provided at sidewalls located on both sides of the cabinet 10 in the width direction of the cabinet 10. The sliding protrusions 142 may extend in the longitudinal direction of the storage unit 140. That is, the sliding protrusions 142 may extend in the movement direction along which the storage unit 140 may be inserted into or withdrawn from the cabinet 10. The sliding protrusions 142 are shown in FIG. 11 to be described later.

Meanwhile, each of the sliding protrusions 142 may be inserted into the sliding groove 115 of the front extension unit 113, such that the sliding protrusion 142 may slide in the movement direction of the storage unit 140.

The sliding groove 115 may be provided at a portion facing the sliding protrusion 142 in the front extension unit 113. That is, the front extension unit 113 may include a portion facing at least a portion of the sidewall of the storage unit 140, and the sliding groove 115 may be located at the inner surface of the front extension unit 113 facing the storage unit 140 so that the front extension unit 113 may be located to face the sliding groove 115.

In the same manner as in the sliding protrusion 142, the sliding groove 115 may be formed in a groove shape extending in the movement direction of the storage unit 140. Accordingly, the storage unit 140 can easily move in the movement direction in a state in which the sliding protrusion 142 is inserted into the sliding groove 115.

In a state in which the stopper 114 is located in front of the front case 110 and the withdrawal of the storage unit 140 is restricted, the laundry treatment apparatus according to the embodiment of the present disclosure may increase the length of the storage unit exposed to the outside of the cabinet 10, and the sliding groove 115 may further extend forward than the rear wall 112, so that the storage unit 140 withdrawn from the cabinet 10 can be stably supported.

Figure 9:
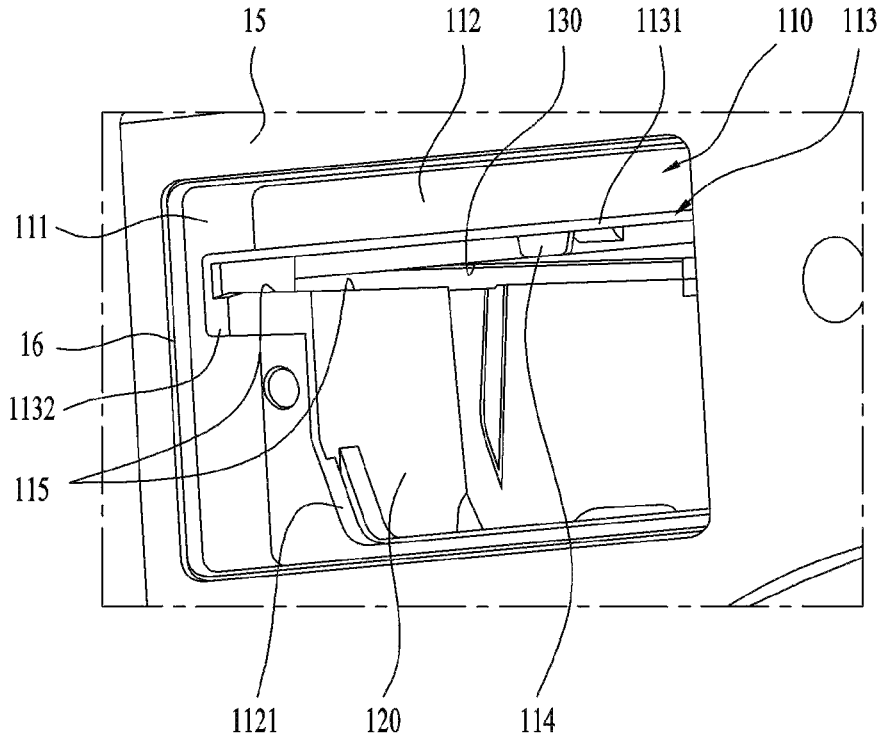
FIG. 9 is a view illustrating a state in which the inside of the detergent supply device is seen through a detergent opening in the laundry treatment apparatus according to an embodiment of the present disclosure.

Meanwhile, FIG. 9 shows a state in which the inside of the supply case is seen through the detergent opening 16. As shown in FIG. 9, the detergent supply device 100 may further include the lower case 120, and the sliding groove 115 may extend along the inner surfaces of the front extension unit 113 and the lower case 120.

As described above, the lower case 120 may be located at the rear side of the front case 110, and may accommodate the remainder of the storage unit 140. For example, the front case 110 may accommodate a front end corresponding to a portion of the storage unit 140, and the lower case 120 may accommodate the remainder excluding the above portion of the storage unit 140.

According to one embodiment of the present disclosure, the sliding groove 115 may be provided not only at the front extension unit 113 of the front case 110 but also at the inner surface of the lower case 120. The sliding groove 115 of the front case 110 and the sliding groove 115 of the lower case 120 may be aligned parallel to each other in the movement direction of the storage unit 140.

In one embodiment of the present disclosure, the sliding protrusion 142 provided in the storage unit 140 may be inserted into the sliding groove 115 provided in the supply case so that the storage unit 140 can slide. The sliding groove 115 may be provided not only in the lower case 120 that accommodates the storage unit 140, but also in the front extension unit 113 of the front case 110. Here, the front extension unit 113 of the front case 110 may increase the withdrawal restriction distance of the storage unit 140. As a result, in a state in which the storage unit 140, the withdrawal restriction distance of which is increased, is effectively and stably supported, the storage unit 140 may slide in the supply case.

Meanwhile, referring again to FIGS. 7 and 8, according to one embodiment of the present disclosure, the front extension unit 113 may include a first extension unit 1131 and a second extension unit 1132. The first extension unit 1131 may be located above the storage unit 140, and the stopper 114 may be provided. The second extension unit 1132 may extend downward from the end of the first extension unit 1131, and may be provided with the sliding groove 115.

The first extension unit 1131 may extend in the width direction of the cabinet 10, and may be located above the storage unit 140. That is, the stopper 114 may protrude downward from the first extension unit 1131 toward the upper surface of the storage unit 140. The first extension unit 1131 may extend along the upper circumference of the through hole 1121 formed in the rear wall 112.

The second extension unit 1132 may extend downward from at least one of both ends of the first extension unit 1131. FIG. 7 is a view illustrating the second extension units 1132 provided at both ends of the first extension unit 1131 according to the embodiment of the present disclosure. The second extension unit 1132 may extend along the circumferences of both sides of the through hole 1121.

That is, the second extension unit 1132 may be provided to face at least a portion of the sidewall of the storage unit 140, and the sliding groove 115 may be provided at one surface of the second extension unit 1132 facing the sidewall of the storage unit 140.

Meanwhile, referring to FIG. 8, the front case 110 according to one embodiment of the present disclosure may be provided such that the length of the opening circumferential wall 111 extending from the rear wall 112 becomes longer than the length of the front extension unit 113.

In FIG. 8, the extension length L1 of the opening circumferential wall 111 extending in the forward and backward directions is longer than the extension length L2 of the front extension unit 113.

In one embodiment of the present disclosure, the front extension unit 113 may be a means for allowing the stopper 114 to be located at a front side of the rear wall 112 to form the sliding groove 115. Therefore, the front extension unit 113 may extend forward from the rear wall 112. However, when the front extension unit 113 extends excessively long, the user may identify the front extension unit 113 through the detergent opening 16 at the outside of the front case 110, thereby degrading the design completeness.

Furthermore, according to one embodiment of the present disclosure, the storage unit 140 may be completely separated from the cabinet 10 according to the user's intention. In this case, the user may align the storage unit 140 in the detergent opening 16 to allow the storage unit 140 to be introduced into the cabinet 10. In this case, the front extension unit 113 extending excessively forward may interfere with the above process in which the storage unit 140 and the detergent opening 16 are aligned and the storage unit 140 is inserted into the cabinet 10.

Accordingly, in one embodiment of the present disclosure, the extension length L2 of the front extension unit 113 may be shorter than the extension length L1 of the opening circumferential wall 111, so that the front extension unit 113 can be prevented from being identified from the outside and can also be prevented from interfering with the insertion process of the storage unit 140 at the outside.

Meanwhile, in one embodiment of the present disclosure, the stopper 114 may be located farther backward than the front end of the front extension unit 113. That is, the stopper 114 may be located between the rear wall 112 and the front end of the front extension unit 113.

The stopper 114 may protrude toward the storage unit 140 from the inner surface facing the storage unit 140 in the front extension unit 113. Then, if the stopper 114 is located excessively close to the front end of the front extension unit 113, this state of the stopper 114 can be recognized from the outside through the detergent opening 16, thereby interfering with the insertion process of the storage unit 140.

According to one embodiment of the present disclosure, the stopper 114 is located posterior to the front end of the front extension unit 113 to minimize the possibility that the stopper 114 that is identified by the user through the detergent opening 16, resulting in improvement in design completeness. In addition, the stopper 114 can minimize the possibility that the storage unit 140 completely separated from the cabinet 10 is re-inserted into the cabinet 10 through the detergent opening 16.

Figure 10:
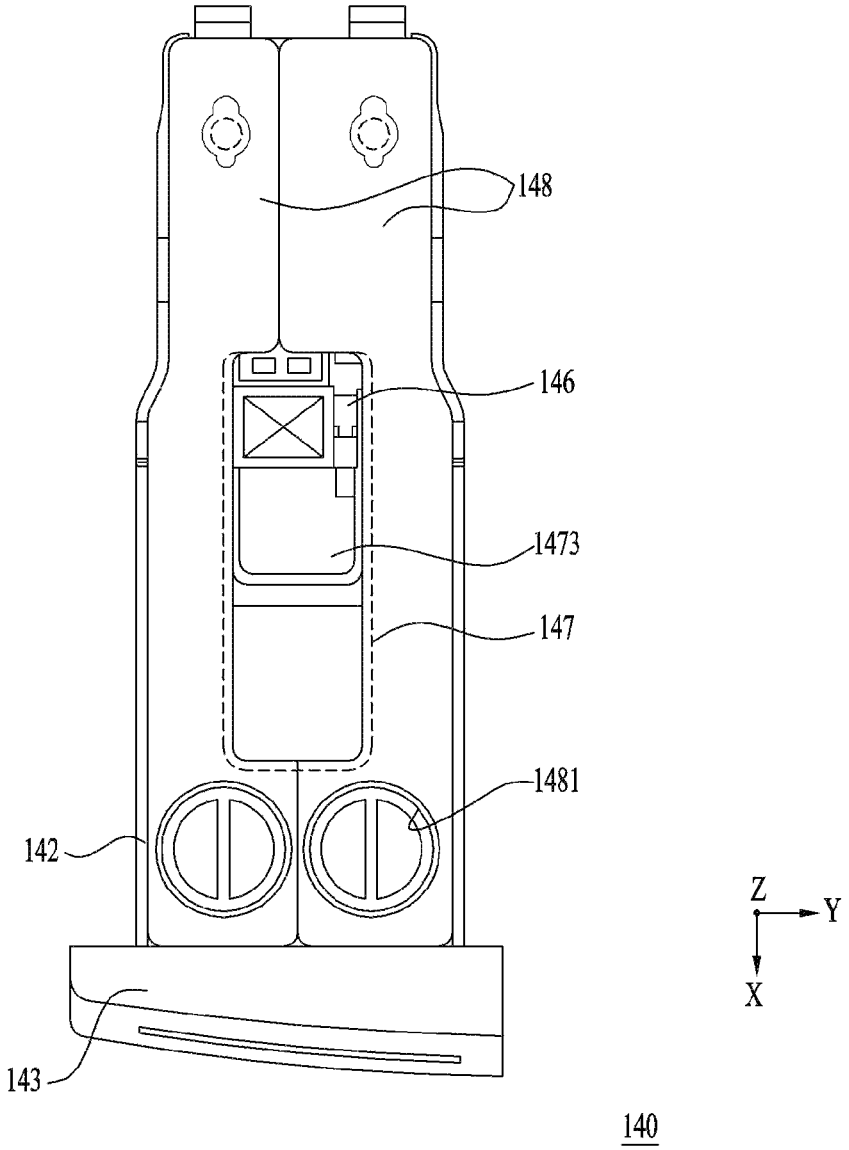
FIG. 10 is a diagram illustrating the storage unit of the detergent supply device in the laundry treatment apparatus according to an embodiment of the present disclosure.

Meanwhile, FIG. 10 shows the storage unit 140 of the detergent supply device 100 in the laundry treatment apparatus 1 according to the embodiment of the present disclosure, and FIG. 11 is a rear view of the storage unit 140 drawn out from the cabinet 10. As shown in FIG. 11, in one embodiment of the present disclosure, the portion of the storage unit 140 may include an extension receiving groove 144 into which the front extension unit 113 is inserted from the rear.

As described above, the portion accommodated in the front case 110 in the storage unit 140 may correspond to the handle 143 of the storage unit 140, and the handle 143 may be supported forward by the rear wall 112 in the front case 110.

However, according to one embodiment of the present disclosure, the front extension unit 113 may be provided to stably support the storage unit 140 as well as to increase the withdrawal restriction distance of the storage unit 140 to be pulled out. In order for the front extension unit 113 protruding forward from the rear wall 112 to interfere with the retraction of the storage unit 140, a groove 144 for accommodating the extension unit (hereinafter referred to as an extension-unit accommodation groove) may be formed at one surface located at a front side of the front extension unit 113 within the storage unit 140.

Accordingly, according to one embodiment of the present disclosure, even if the front extension unit 113 extending forward from the rear wall 112 is provided inside the front case 110, the storage unit 140 can be completely inserted into the front case 110 without interference between the front extension unit 113 and the storage unit 140.

Figure 12:
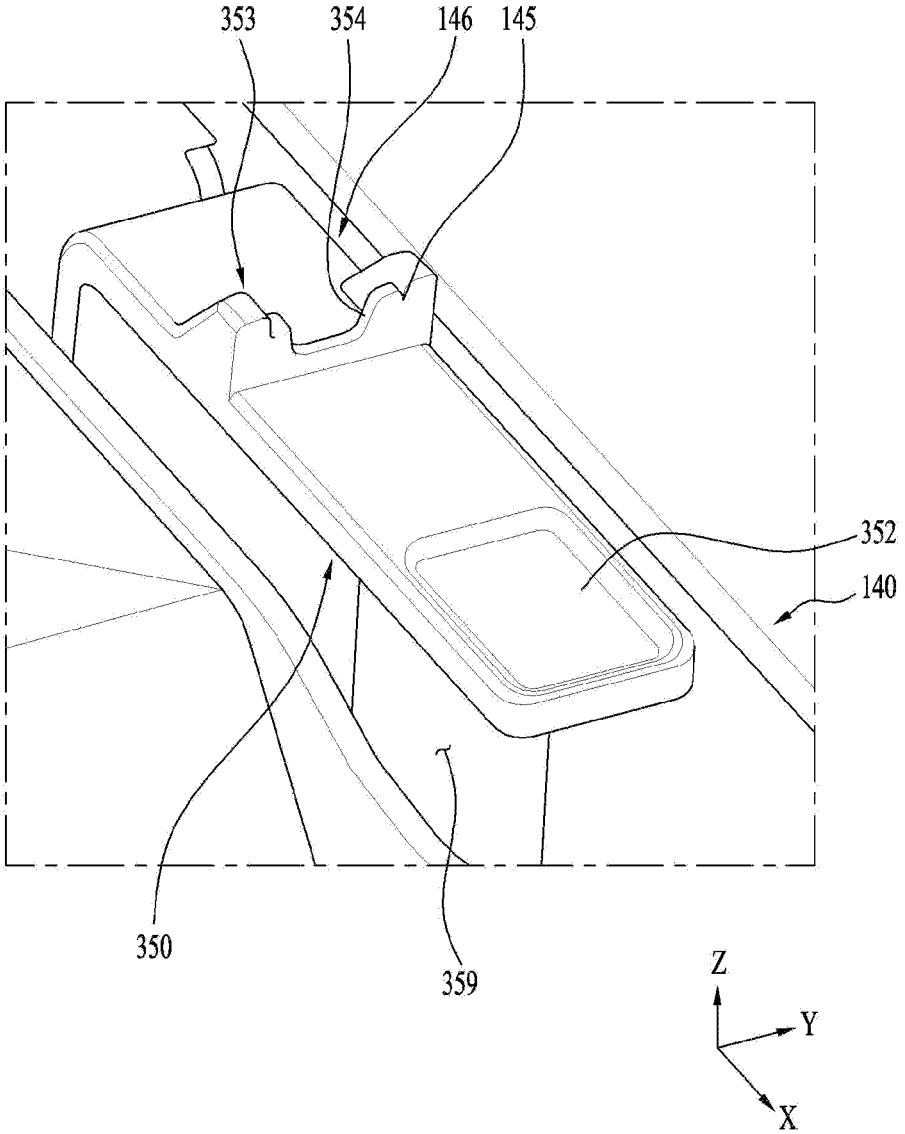
FIG. 12 is a diagram illustrating a withdrawal restriction bar of the storage unit in the laundry treatment apparatus according to an embodiment of the present disclosure.

Meanwhile, FIG. 12 shows a restriction protrusion 145 and a withdrawal restriction bar 146 provided on the storage unit 140 according to the embodiment of the present disclosure.

Referring to FIG. 12, according to one embodiment of the present disclosure, the storage unit 140 may include a restriction protrusion 145, and the restriction protrusion 145 may protrude to overlap the stopper 114 in the movement direction of the storage unit 140. During the withdrawal process of the storage unit 140, the restriction protrusion 145 may come into contact with the stopper 114 to restrict the withdrawal distance of the storage unit 140.

Specifically, the restriction protrusion 145 may be provided to protrude from the storage unit 140. At least a portion of the restriction protrusion 145 may be provided to overlap the stopper 114 in the movement direction of the storage unit 140. That is, at least a portion of the restriction protrusion 145 may be located at a rear side of the stopper 114.

The restriction protrusion 145 may be molded integrally with the storage unit 140 or separately manufactured, and may be coupled to the storage unit 140. The restriction protrusion 145 may be provided to protrude from the sidewall or inner wall of the storage unit 140, or may be provided at a separate structure coupled to the storage unit 140.

FIG. 12 is a view illustrating the restriction protrusion 145 provided at the withdrawal restriction bar 146 to be described later. FIG. 10 schematically shows the withdrawal restriction bar 146 provided in the storage unit 140. However, the restriction protrusion 145 may be provided at various positions other than the withdrawal restriction bar 146 as needed.

The restriction protrusion 145 may protrude outward from the storage unit 140. In one embodiment of the present disclosure, the stopper 114 may protrude downward from the first extension unit 1131, and the restriction protrusion 145 may be provided in a shape that protrudes upward from the upper surface of the storage unit 140.

Figure 13:
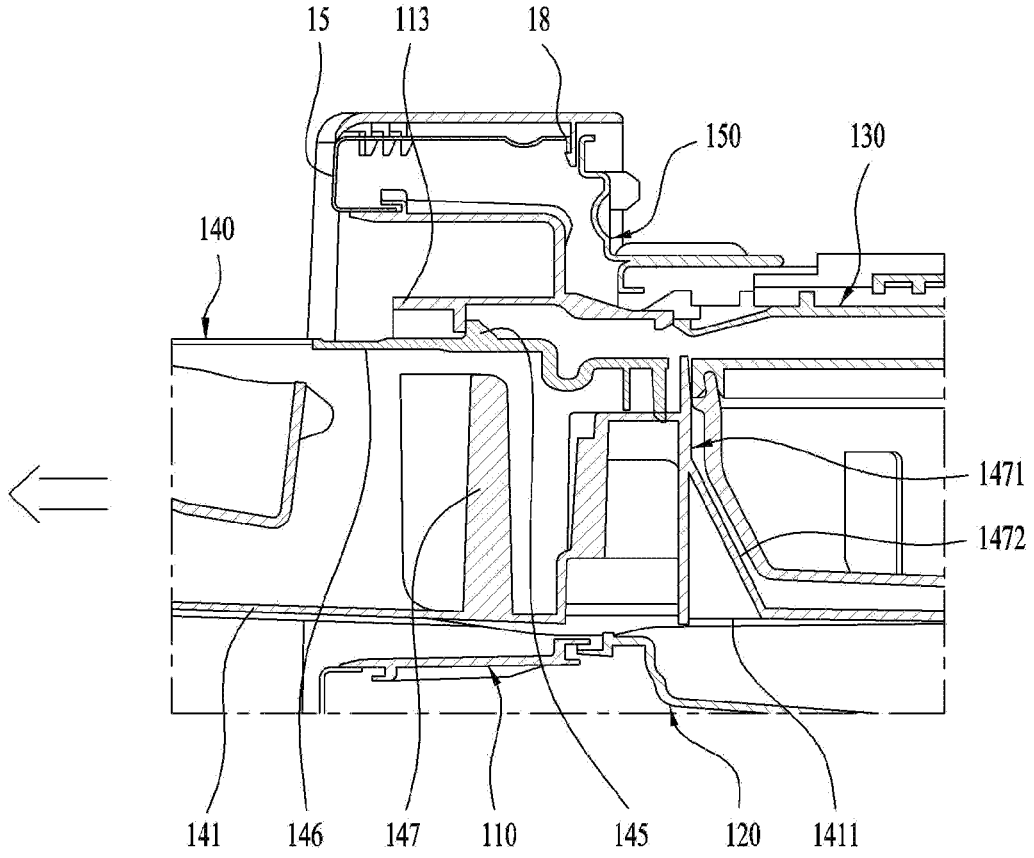
FIG. 13 is a diagram illustrating a storage unit in a state in which a restriction protrusion is in contact with a stopper in the laundry treatment apparatus according to an embodiment of the present disclosure.

Meanwhile, as shown in FIG. 13, in the process of pulling out the storage unit 140 from the inside of the cabinet 10 according to the embodiment of the present disclosure, the restriction protrusion 145 and the stopper 114 are in contact with each other so that the withdrawal distance of the storage unit 140 is restricted.

Referring to FIG. 13, the storage unit 140 may be spaced apart from the rear side of the stopper 114 while the cabinet 10 is completely inserted into the storage unit 140. In this case, the separation distance between the restriction protrusion 145 and the stopper 114 may correspond to the withdrawal restriction distance of the storage unit 140.

When the storage unit 140 completely inserted into the cabinet 10 is moved forward and withdrawn, the restriction protrusion 145 located at the rear side of the stopper 114 gradually moves forward to the stopper 114 through the movement of the storage unit 140, and the restriction protrusion 145 comes into contact with the stopper 114 as shown in FIG. 13.

When the restriction protrusion 145 is in contact with the stopper 114, the stopper 114 physically blocks forward movement of the restriction protrusion 145. As the forward movement of the restriction protrusion 145 is blocked, forward movement of the storage unit 140 is also restricted, and the storage unit 140 may be withdrawn forward by a withdrawal restriction distance.

As the restriction protrusion 145 protruding from the storage unit 140 is disposed at the rear side of the stopper 114, a structure in which the withdrawal distance of the storage unit 140 is effectively restricted by the stopper 114 can be implemented.

Figure 14:
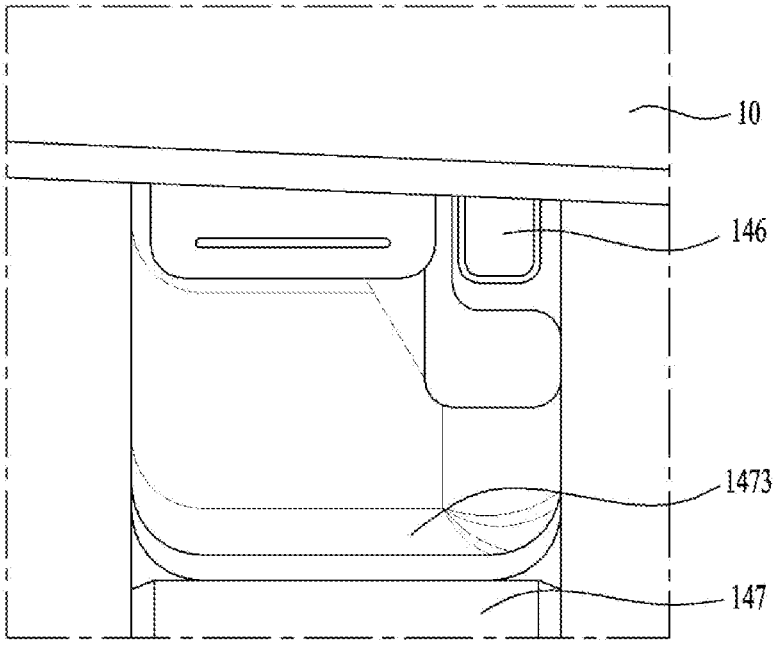
FIG. 14 is a diagram illustrating a detergent cup exposed to the outside in a state in which the withdrawal distance of the storage unit is restricted in the laundry treatment apparatus according to an embodiment of the present disclosure.

Meanwhile, FIG. 10 shows the withdrawal restriction bar 146 provided in the storage unit 140, FIG. 13 is a perspective view of the withdrawal restriction bar 146, and FIG. 14 shows the withdrawal restriction bar 146 and a detergent cup 1473 that are exposed to the outside of the detergent opening 16 in a state in which the storage unit 140 is withdrawn by the withdrawal restriction distance.

Referring to FIGS. 10, 13, and 14, the storage unit 140 may include a withdrawal restriction bar 146, one end of which is fixed based on the movement direction of the storage unit 140 and the other end of which forms a free end.

The stopper 114 is provided in the withdrawal restriction bar 146 so that the position of the stopper 114 may change in response to the movement of the other end of the withdrawal restriction bar 116, and the other end of the withdrawal restriction bar 116 can be exposed to the outside through the detergent opening 16 in a state in which the restriction protrusion 145 contacts the stopper 114.

The withdrawal restriction bar 146 may be molded integrally with the storage unit 140 or separately manufactured, so that the withdrawal restriction bar 146 can be coupled to the body of the storage unit 140. The withdrawal restriction bar 146 may have one end fixed to the storage unit 140 and the other end forming a free end, so that the position thereof can be changed.

The storage unit 140 may move in the forward and backward directions, and the withdrawal restriction bar 146 may extend in the forward and backward directions. That is, any one of the front end or the rear end of the withdrawal restriction bar 146 may be fixed to the storage unit 140, and the other one may form a free end.

FIG. 13 shows the withdrawal restriction bar 146, the rear end of which is fixed and the front end of which forms a free end, according to an embodiment of the present disclosure, but is not limited thereto.

A restriction protrusion 145 may be provided at the withdrawal restriction bar 146, and the restriction protrusion 145 may be provided to protrude upward from the withdrawal restriction bar 146. Accordingly, the withdrawal restriction bar 146 may be a means for changing whether or not the withdrawal of the storage unit 140 is restricted by the restriction protrusion 145.

For example, according to an embodiment of the present disclosure, the position of one end of the withdrawal restriction bar 146 may be fixed and the position of the other end of the withdrawal restriction bar 146 may be changed. The restriction protrusion 145 may protrude upward from the withdrawal restriction bar 146, and the other end thereof may be provided to be movable in the vertical direction.

That is, the other end of the withdrawal restriction bar 146 may be bent to move downward when pressed downward. In this case, the restriction protrusion 145 can move downward together with the above other end of the withdrawal restriction bar 146 due to deformation of the withdrawal restriction bar 146.

When the restriction protrusion 145 moves downward, the restriction protrusion 145 is no longer located at the rear side of the stopper 114. Therefore, during the withdrawal process of the storage unit 140, restriction of the withdrawal distance of the storage unit 140 affected by the stopper 114 and the restriction protrusion 145 is not achieved.

That is, the laundry treatment apparatus 1 according to the embodiment of the present disclosure may allow the user to press the front end of the withdrawal restriction bar 146 downward during the withdrawal process of the storage unit 140, so that the withdrawal distance restriction of the storage unit 140 can be released and the storage unit 140 can be completely separated from the cabinet 10 according to user convenience.

However, when at least a portion of the withdrawal restriction bar 146 (e.g., the front end of the withdrawal restriction bar 146) is not exposed to the outside of the cabinet 10 in a state in which the storage unit 140 is pulled out by a withdrawal restriction distance by which the stopper 114 is in contact with the restriction protrusion 145, it may be difficult for the user to address the withdrawal distance restriction of the storage unit 140.

Therefore, the free end (e.g., the front end) of the withdrawal restriction bar 146 is exposed to the outside through the detergent opening 16 while the stopper 114 and the restriction protrusion 145 are in contact with each other. Accordingly, the user can conveniently determine whether to restrict the withdrawal distance of the storage unit 140.

Meanwhile, FIG. 10 shows a detergent cup 1473 provided at the storage unit 140 according to the embodiment of the present disclosure, and FIG. 14 shows a detergent cap exposed to the outside of the cabinet 10.

Referring to FIGS. 10 and 14, the storage unit 140 may further include a detergent cup 1473 with an opened upper surface to receive detergent therein. The storage unit 140 may be configured such that at least a portion of the opened upper surface of the detergent cup 1473 may be exposed to the outside through the detergent opening 16 in a state in which the restriction protrusion 145 is in contact with the stopper 114.

The detergent cup 1473 may be provided in the storage unit 140 so that detergent can be stored therein. Specifically, the storage unit 140 may include a storage frame provided with a handle 143 that is provided at the front end of the storage unit 140, and the detergent cup 1473 may be provided in the storage frame. The above-mentioned withdrawal restriction bar 146 may also be coupled and fixed to the storage frame.

The detergent cup 1473 may be disposed inside the detergent receiver 147 to be described later, and detergent may be supplied to the inside of the detergent cup 1473 through the opened upper surface of the detergent cup 1473. That is, the user may replenish detergent in the detergent cup 1473 as necessary, and then the washing process can be performed.

The storage unit 140 may be pulled out from the cabinet 10 by the withdrawal restriction distance, and may be used. However, if the opened upper surface of the detergent cup 1473 is not sufficiently exposed to the outside of the cabinet 10 in a state in which the storage unit 140 is pulled out by the withdrawal restriction distance, the user may feel inconvenience in replenishing detergent in the detergent cup 1473.

Accordingly, according to the embodiment of the present disclosure, the withdrawal distance of the storage unit 140 may be effectively restricted using the stopper 114 and the restriction protrusion 145, and at the same time not only the withdrawal restriction bar 146 but also at least a portion of the opened upper surface of the detergent cup 1473 may be exposed to the outside through the detergent opening 16, so that the user can conveniently use the detergent cup 1473.

Figure 15:
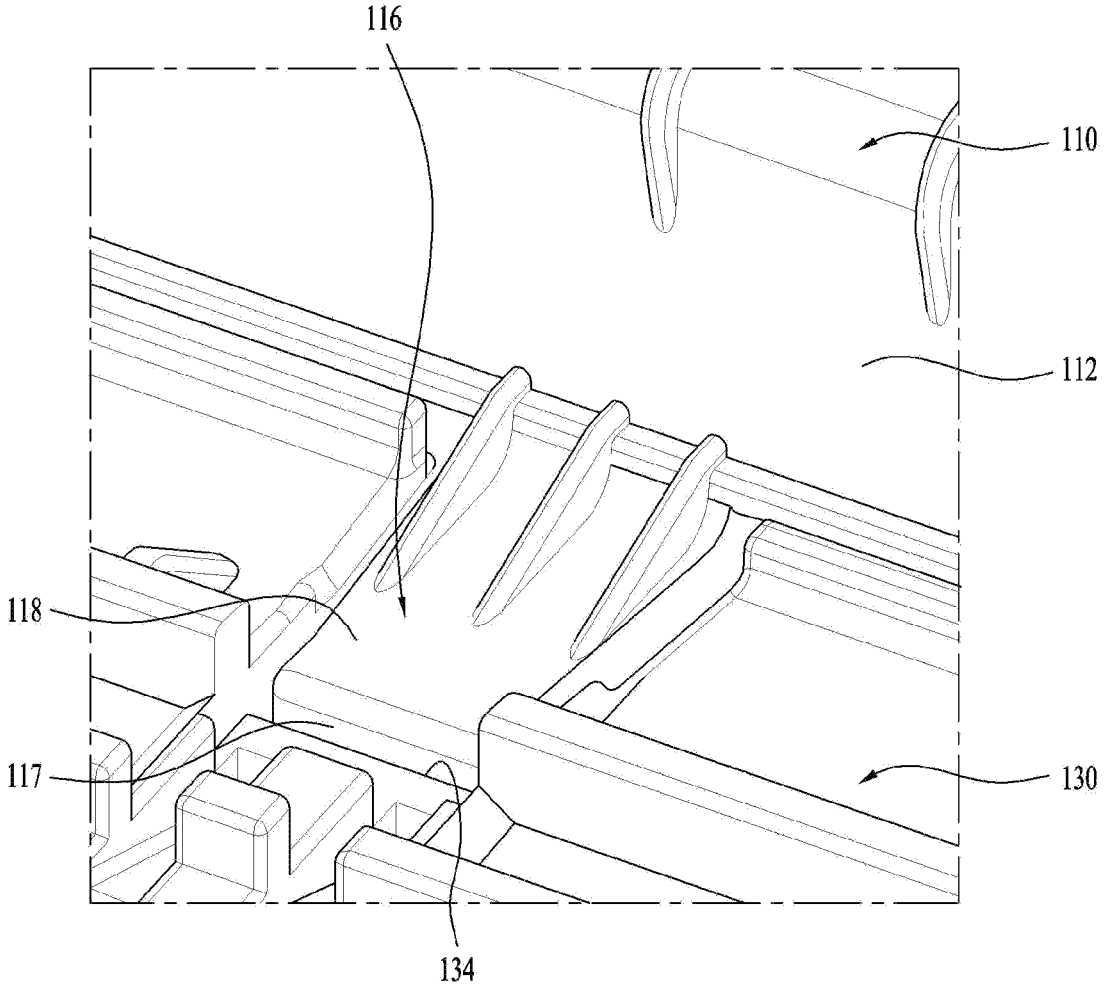
FIG. 15 is a diagram illustrating an upper hook provided on the front case of the laundry treatment apparatus according to an embodiment of the present disclosure.

Meanwhile, FIG. 15 shows an upper hook 116 provided in the front case 110 according to the embodiment of the present disclosure. As shown in FIG. 15, the detergent supply device 100 may further include an upper case 130. The upper case 130 may be disposed at the rear side of the front case 110, and may be provided to cover the storage unit 140 when viewed from the top.

In addition, the front case 110 may include an upper hook 116. The upper hook 116 may extend rearward from the rear wall 112, may be fastened to the upper case 130, and may fix the upper case 130.

As described above, the upper case 130 may be located at the upper surface of the lower case 120 at the rear side of the front case 110. The upper case 130 may be provided to cover the storage unit 140 disposed in the lower case 120 when viewed from the top.

The upper hook 116 may be provided in the front case 110, and may serve as a coupling means between the upper case 130 and the front case 110. The upper hook 116 may extend rearward from the rear wall 112 of the front case 110, and may be hook-coupled (or hooked) to the upper case 130.

The upper hook 116 may be provided in the front case 110, so that the upper hook 116 and the front case 110 can be effectively coupled to each other. Various types of the upper hooks 116 may be used, and one or more upper hooks 116 may also be used as necessary. The upper case 130 may have not only the upper hook 116, but also an additional coupling structure with the front case 110 such as a bolt coupling structure.

Meanwhile, as shown in FIG. 15, the upper hook 116 may be coupled to the upper case 130 when viewed from the upper case 130. That is, the upper hook 116 may protrude rearward from the rear wall 112 of the front case 110, may be disposed at the upper surface of the upper case 130, and may be coupled to the upper case 130.

Figure 16:
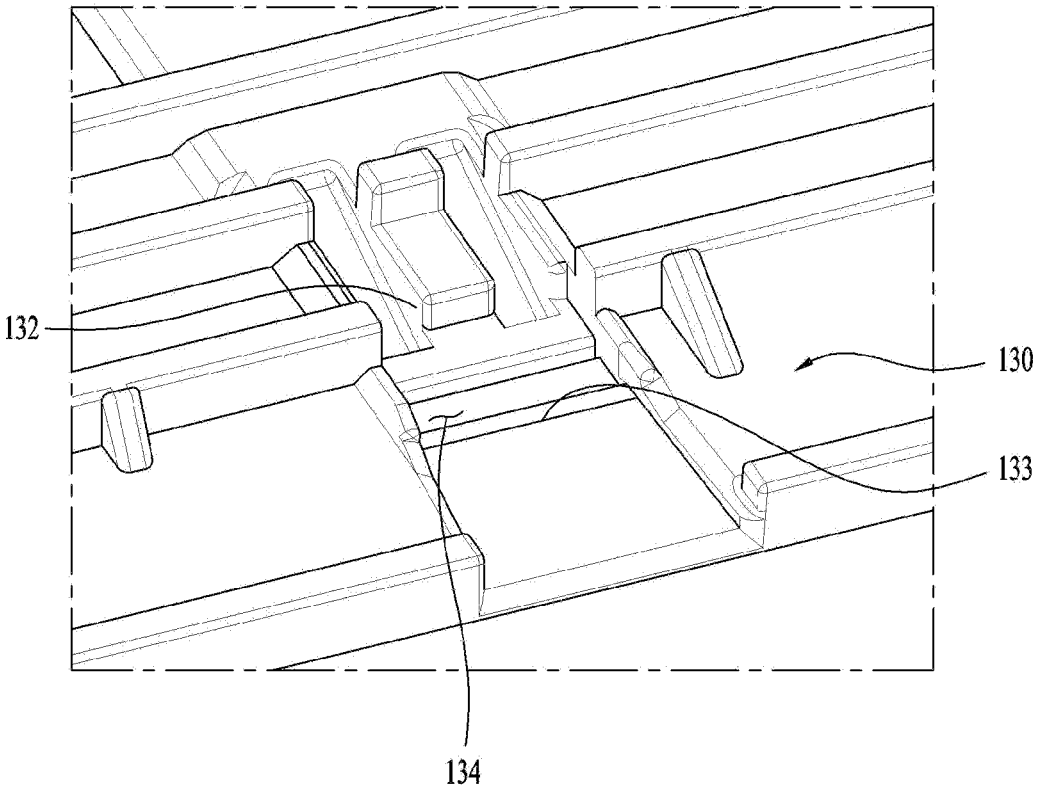
FIG. 16 is a diagram illustrating an opening hole provided in the upper case of the laundry treatment apparatus according to an embodiment of the present disclosure.
Figure 17:
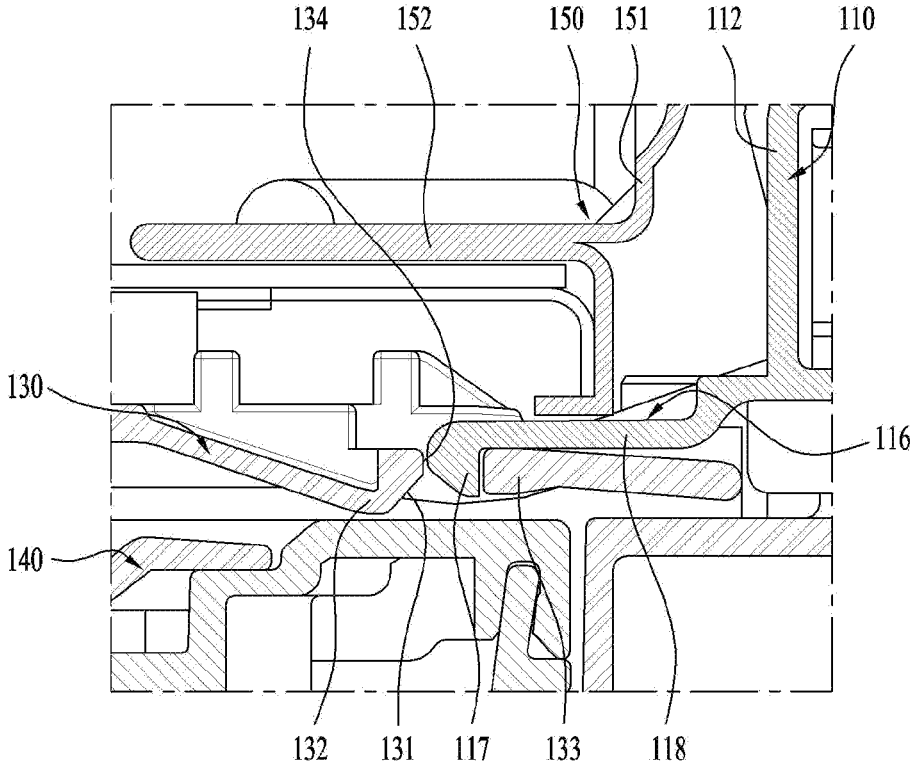
FIG. 17 is a diagram illustrating an upper hook coupled to an upper case of another laundry treatment apparatus according to an embodiment of the present disclosure.

FIG. 16 shows an open hole 134 into which a hook protrusion 117 of the upper hook 116 is inserted in the upper case 130 according to an embodiment of the present disclosure, and FIG. 17 is a cross-sectional view illustrating the upper case 1390 coupled to the upper hook 116.

Referring to FIGS. 16 and 17, the upper case 130 may include the protrusion groove 131 into which the stopper 114 is inserted during the withdrawal process of the storage unit 140, so that the protrusion groove 131 is formed at one surface facing the storage unit 140 in the upper case 130 and forward movement of the stopper 114 is restricted. The stopper 114 may prevent the upper hook 116 from being inserted into the protrusion groove 131 by the hook protrusion 117 caught on the upper case 130.

Specifically, the upper case 130 may be provided to cover the upper surface of the storage unit 140, and a protrusion groove 131 may be formed at one surface (i.e., a lower surface) facing the storage unit 140. The protrusion groove 131 may be provided in a shape that is recessed away from the storage unit 140 at the one surface of the upper case 130.

The protrusion groove 131 may be located at a front side of the restriction protrusion 145 of the storage unit 140. That is, the restriction protrusion 145 may be inserted into the protrusion groove 131 of the upper case 130 to restrict forward movement of the storage unit 140. That is, the protrusion groove 131 may perform the same role as the stopper 114 of the front case 110 described above.

However, when the front case 110 is provided with the stopper 114 to increase the withdrawal restriction distance of the storage unit 140, the upper case 130 may be configured such that the protrusion groove 131 is no longer used and the hook protrusion 117 of the upper hook 116 is inserted into the protrusion groove 131. Thus, the inside of the protrusion groove 131 is filled by the hook protrusion 113, so that the restriction protrusion 145 may move forward without being inserted into the protrusion groove 131 during forward movement of the storage unit 140.

Referring to FIG. 17, the upper case 130 may be provided with a restriction guide protrusion 132 at the front side the protrusion groove 131, and a locking protrusion 133 may be provided at the rear side of the protrusion groove 131. The restriction guide protrusion 132 and the locking protrusion 133 may protrude downward from the lower surface of the upper case 130, and the protrusion groove 131 may be disposed between the restriction guide protrusion 132 and the locking protrusion 133.

The restriction guide protrusion 132 and the locking protrusion 133 may be aligned in parallel with the restriction protrusion 145 of the storage unit (140) in the forward and backward directions. That is, in a state in which the storage unit 140 is completely inserted into the cabinet 10, the restriction guide protrusion 132 may be located at the front side of the restriction protrusion 145, and the locking protrusion 133 may be located at the front side of the restriction guide protrusion 132.

As the restriction guide protrusion 132 approaches the detergent opening 16, the height of the restriction guide protrusion 132 protruding from the upper case 130 increases, resulting in formation of an inclined surface. The inclined surface of the restriction guide protrusion 132 may press the restriction protrusion 145 so that the free ends of the restriction protrusion 145 and the withdrawal restriction bar 146 that pass through the restriction guide protrusion 132 move downward.

In the same manner as the stopper 114 described above, the locking protrusion 133 may be provided to block forward movement of the restriction protrusion 145 located in the protrusion groove 131. That is, the locking protrusion 133 may be located at the front side of the restriction protrusion 145 that has moved back to the original position through the restriction guide protrusion 132, so that the locking protrusion 133 may prevent the restriction protrusion 145 from moving forward through physical contact.

The front end of the withdrawal restriction bar 146 may form a free end, and for various reasons, a portion of the free end may be located at the rear side of the locking protrusion 133 during the withdrawal process of the storage unit 140, so that the portion of the free end can be caught on the locking protrusion 133.

In this case, the storage unit 140 may not be pulled out by a design-intended withdrawal restriction distance, and impact may occur when the withdrawal restriction bar 146 and the locking protrusion 133 are in contact with each other, so that damage to either the locking protrusion 133 or the withdrawal restriction bar 146 may also occur.

Accordingly, the upper case 130 may be provided with the restriction guide protrusion 132 having an inclined surface at the rear side of the protrusion groove 131. Before the withdrawal restriction bar 146 is caught on the step-shaped locking protrusion 133, the free end of the withdrawal restriction bar 146 is located lower than at least the locking protrusion 133 by the inclined surface of the restriction guide protrusion 132, so that physical contact between the locking protrusion 133 and the withdrawal restriction bar 145 can be prevented.

In one embodiment of the present disclosure, the restriction protrusion 145, the protrusion groove 131, the hook protrusion 117, and the stopper 114 may be aligned in parallel to each other in the movement direction.

Meanwhile, the upper case 130 may include an open hole 134 through which the inside of the protrusion groove 131 communicates with the outside of the upper case 130, and the hook protrusion 117 may be inserted into the protrusion groove 131 through the open hole 134 so that the stopper 114 is prevented from being inserted into the protrusion groove 131.

The open hole 134 may be provided to allow an upper portion of the protrusion groove 131 to communicate with the outside of the protrusion groove 131. That is, the open hole 134 may be provided to penetrate the upper case 130 in the vertical direction. The protrusion groove 131 may be exposed to the outside of the upper case 130 by the open hole 134.

The upper hook 116 may include a hook extension unit 118 extending rearward from the rear wall 112 of the front case 110, and a hook protrusion 117 protruding from the hook extension 118 toward the upper case 130.

The hook protrusion 117 may be inserted into the open hole 134 of the upper case 130 to form a coupling between the upper case 130 and the front case 110. At least a portion of the hook protrusion 117 is disposed in the protrusion groove 131 through the opening hole 134. Thus, during the withdrawal process of the storage unit 140, the restriction protrusion 145 may not be completely inserted into the protrusion groove 131 due to physical interference of the hook protrusion 117, and may move forward through the protrusion groove 131.

After passing through the protrusion groove 131 without being caught by the locking protrusion 133, the restriction protrusion 145 may be caught by the stopper 114 of the front case 110, so that the withdrawal restriction distance of the storage unit 140 can be determined by the stopper 114.

The upper case 130 may have a protrusion groove 131 separately from the front case 110, and thus can be commonly used for other types in which the stopper 114 is not separately provided in the front case 110.

That is, when the length of the front panel 15 changes for various reasons, such as changes in the internal components of the front panel 15, unlike the present disclosure, the upper hook 116 and the stopper 114 are removed from the front case 110 and the protrusion groove 131 of the upper case 130 is used, so that the withdrawal restriction distance of the storage unit 140 can be easily reduced.

That is, even if the stopper 114 is provided in the front case 110, the protrusion groove 131 of the upper case 130 is maintained, but the function of the protrusion groove 131 disappears through the upper hook 116 of the front case 110, so that the withdrawal distance of the storage unit 140 can be effectively restricted through the stopper 114 of the front case 110. Furthermore, when the user wants to reduce the withdrawal distance of the storage unit 140, the upper case 130 can be used for common purposes, which may be advantageous in terms of design and manufacturing process.

Figure 18:
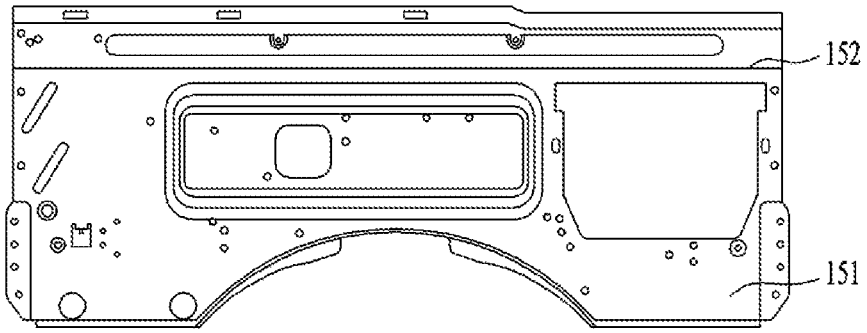
FIG. 18 is a diagram illustrating a panel reinforcement unit in the laundry treatment apparatus according to an embodiment of the present disclosure.
Figure 19:
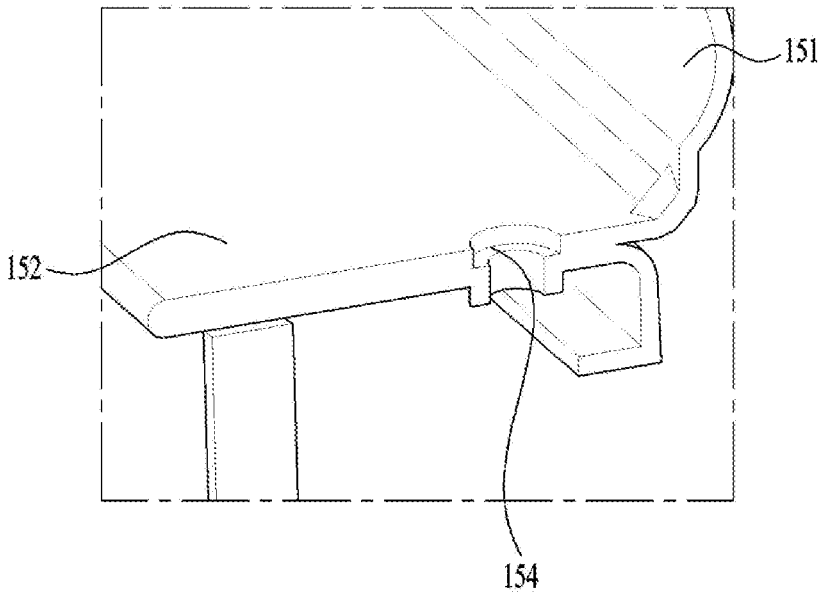
FIG. 19 is a diagram illustrating an extension reinforcement unit of the panel reinforcement unit in the laundry treatment apparatus according to an embodiment of the present disclosure.
Figure 20:
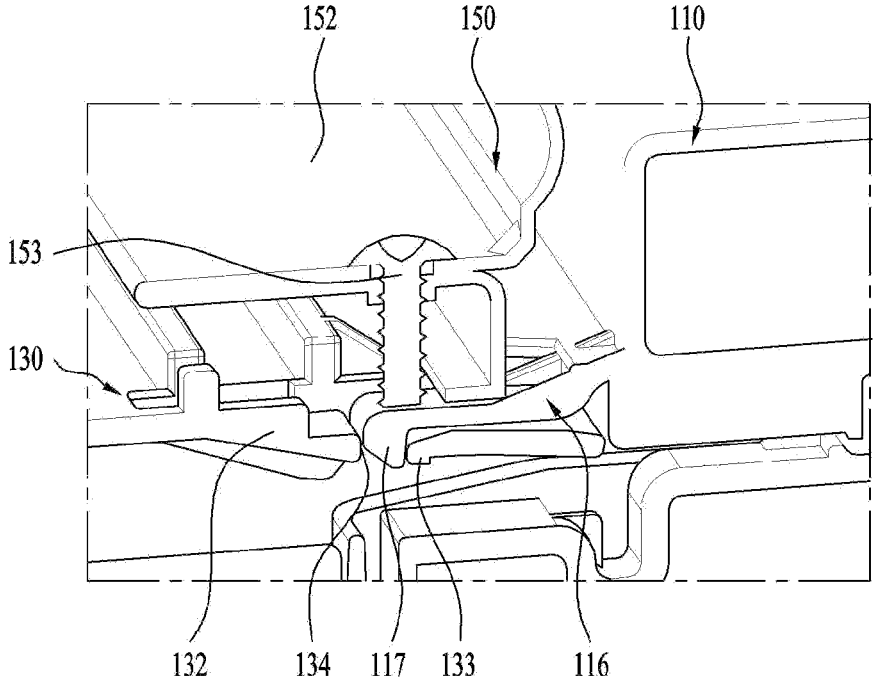
FIG. 20 is a diagram illustrating a combined reinforcement unit of the panel reinforcement unit in the laundry treatment apparatus according to an embodiment of the present disclosure.

Meanwhile, FIG. 18 shows the panel reinforcement unit 150 of the laundry treatment apparatus 1 according to the embodiment of the present disclosure. FIG. 19 shows the extension reinforcement unit 152 of the panel reinforcement unit 150 according to the embodiment of the present disclosure. FIG. 20 shows the coupling reinforcement unit 153 according to the embodiment of the present disclosure.

Referring to FIGS. 18 to 20, the cabinet 10 may further include the panel reinforcement unit 150, and the panel reinforcement unit 150 may be coupled to the front panel 15 at the rear side of the front panel 15.

Meanwhile, the panel reinforcement unit 150 may include the coupling reinforcement unit 153, and the coupling reinforcement unit 153 may protrude toward the upper hook 116 to prevent separation between the upper hook 116 and the upper case 130.

Specifically, the cabinet 10 may further include the panel reinforcement unit 150 located at the rear side of the front panel 15. The panel reinforcement unit 150 may be disposed between the upper portion of the front panel 15, the side panel, and the upper panel, and may be coupled to at least one of the front panel 15, the side panel, and the upper panel.

The panel reinforcement unit 150 may be provided in a plate shape parallel to the front surface of the cabinet 10. The panel reinforcement unit 150 may be coupled to the panel flange 18 of the front panel 15, and may increase the rigidity of the front panel 15. The above-described operation unit 50, etc. may be coupled to and fixed to the panel reinforcement unit 150. A portion of the panel reinforcement unit 150 may be located at a rear side of the detergent opening 16, and may be penetrated by the storage unit 140. That is, the storage unit 140 may be accommodated in the lower case 120 through the detergent opening 16, the front case 110, and the panel reinforcement unit 150.

Meanwhile, the coupling reinforcement unit 153 of the panel reinforcement unit 150 may protrude from the panel reinforcement unit 150 toward the upper hook 116. For example, the coupling reinforcement unit 153 may be located above the upper hook 116 so that the end portion thereof can protrude toward the upper hook 116.

As described above, the upper hook 116 may be fastened to the open hole 134 provided at the upper surface of the upper case 130. When the upper hook 116 is spaced upward from the upper case 130 for various reasons, such fastening between the upper case 130 and the upper hook 116 can be released.

Accordingly, the coupling reinforcement unit 153 may be provided in the panel reinforcement unit 150 corresponding to a fixed body. Since the end of the coupling reinforcement unit 153 may be located above the upper hook 116, the upper hook 116 is prevented from being separated upward from the upper case 130 and thus fastening between the upper hook 116 and the upper case 130 can be prevented from being released.

Meanwhile, the panel reinforcement unit 150 may include a main reinforcement unit 150 coupled to the front panel 15 and an extension reinforcement unit 152 extending rearward from the main reinforcement unit 150. The coupling reinforcement unit 153 may be provided at the extension reinforcement unit 152, and may protrude toward the upper hook 116.

The main reinforcement unit 150 may be provided in a plate shape that is parallel to either the front panel 15 or the front surface of the cabinet 10, and may have the same width as the front panel 15 with respect to a lateral direction of the cabinet 10.

The extension reinforcement unit 152 may be provided to protrude rearward from the main reinforcement unit 150. The extension reinforcement unit 152 may increase the rigidity of the plate-shaped main reinforcement unit 150. Although the extension reinforcement unit 152 has the same width as each of the main reinforcement unit 150 and the front panel 15, the scope or spirit of the present disclosure is not limited thereto, and it should be noted that the length of the extension reinforcement unit 152 extending in the lateral direction may vary.

Meanwhile, the extension reinforcement unit 152 may be located above the detergent supply device 100. That is, the extension reinforcement unit 152 may be located above the upper hook 116, and the coupling reinforcement unit 153 may be provided on the extension reinforcement unit 152.

For example, at least a portion of the extension reinforcement unit 152 may be located above the upper hook 116, and the coupling reinforcement unit 153 may be formed to protrude downward from at least a portion of the extension reinforcement unit 152, so that the end portion thereof may be located above the upper hook 116. The coupling reinforcement unit 153 may be located above the hook protrusion 117 so that the end portion thereof can prevent separation of the hook protrusion 117.

The coupling reinforcement unit 153 may be provided in various types. For example, the coupling reinforcement unit 153 may be molded integrally with the extension reinforcement unit 152, and may be provided as a type of a bolt or the like as shown in FIG. 20, so that the coupling reinforcement unit 153 can be coupled to the extension reinforcement unit 152 to penetrate the extension reinforcement unit 152 when viewed from the top.

Referring to FIG. 20, the coupling reinforcement unit 153 may be manufactured separately from the extension reinforcement unit 152, and may be coupled to the extension reinforcement unit 152. The extension reinforcement unit 152 may include a coupling hole 152 into which the coupling reinforcement unit 152 is inserted. The coupling reinforcement unit 153 may be coupled to the coupling hole 154 so that the end portion thereof may protrude from the extension reinforcement unit 152 toward the upper hook 116.

According to the embodiment of the present disclosure, the panel reinforcement unit 150 may be provided to secure the rigidity of the front panel 15 and to fix the operation unit 50, etc. The panel reinforcement unit 150 may be provided with the extension reinforcement unit 152 to secure the rigidity of the main reinforcement unit 150. As the coupling reinforcement unit 153 is provided in the extension reinforcement unit 152, coupling between the upper hook 116 and the upper case 130 can be maintained in the storage unit 140 and coupling between the front case 110 and the upper case 130 can be maintained.

As described above, the front case 110 may include a front extension unit 113 extending forward from the rear wall 112, and a sliding protrusion unit 142 extending in the movement direction of the storage unit 140 may be provided at the sidewall of the storage unit 140. In addition, a sliding groove 115 extending in the movement direction of the storage unit 140 may be provided at a portion facing the sliding protrusion part 142 in the front extension unit 113, so that the sliding protrusion unit 142 can slide along the sliding groove 115.

In addition, as described above, the detergent supply device 100 may include the storage unit 140, the front case 110, and the upper case 139. The front case 110 may include an upper hook 116. The upper hook 116 may extend rearward from the rear wall 12, may be fastened to the upper case 130, and may fix the upper case 130.

Figure 21:
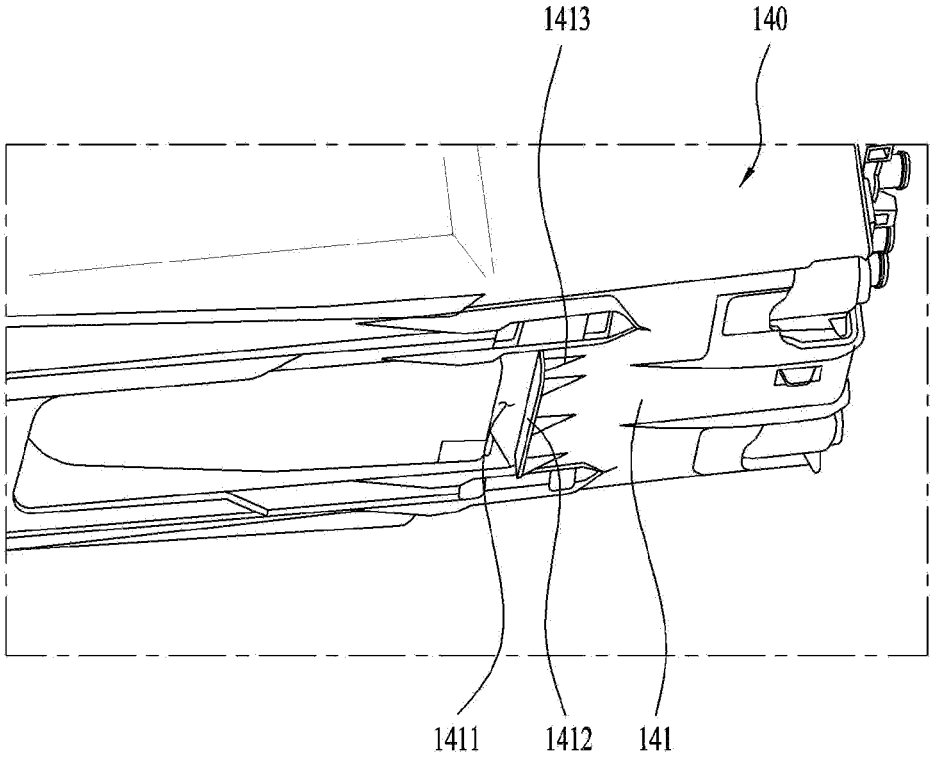
FIG. 21 is a diagram illustrating a detergent discharge hole and an anti-scattering rib of the storage unit in the laundry treatment apparatus according to an embodiment of the present disclosure.

Meanwhile, FIG. 21 shows the bottom surface 141 of the storage unit 140 according to the embodiment of the present disclosure. Referring to FIG. 21, the laundry treatment apparatus 1 according to the embodiment of the present disclosure may include a detergent discharge hole 1411 and an anti-scattering rib 142 that are provided at the bottom surface 141 of the storage unit 140. The detergent discharge hole 1411 may be formed such that the detergent can be discharged to the outside therethrough. The anti-scattering rib 1412 may extend downward, and may suppress scattering of detergent discharged from the detergent discharge hole 1411.

First, the storage unit 140 will be described in detail with reference to FIG. 10. The storage unit 140 may include a detergent storage box 148 and a detergent receiver 147. The detergent storage box 148 may store liquid detergent, may include a detergent hole through which the outside of the detergent storage box 148 communicates with the inside of the detergent storage box 148, and may include a detergent cap coupled to the detergent hole to open and close the detergent hole.

The detergent storage box 148 may be configured such that the detergent hole and the detergent cup 1473 are exposed to the outside of the detergent opening 16 in a state in which the detergent hole and the detergent cap are located at the front end and the user pulls out (or withdraws) the storage unit 140 by the withdrawal restriction distance.

Meanwhile, the detergent container 147 corresponds to a space separated from the detergent storage box 148, and the upper surface thereof is opened so that detergent can be supplied through the opened upper surface. Detergent stored in the detergent container 147 may be discharged to the outside of the storage unit 140 through the detergent discharge hole 1411.

The detergent container 147 may be provided with the detergent cup 1473 described above. The detergent cup 1473 may occupy the entire area of the detergent container 147 or may occupy only a portion of the detergent container 147. Referring to FIG. 10, the detergent cup 1473 may be provided at the rear side of the detergent container 147, and detergent may be stored in a region in which the detergent cup 1473 is not located in the detergent container 147 so that the detergent may be stored in the region having no detergent cup in a different way from the detergent cup 1473.

Referring again to FIG. 21, the detergent discharge hole 1411 may communicate with a space in which detergent is stored in the detergent storage box 148, and may serve as a path through which detergent is discharged. For example, the detergent discharge hole 1411 may communicate with the detergent container 147, and may serve as a path through which detergent stored in the detergent container 147 is discharged to the outside of the storage unit 140.

When the detergent container 147 is provided with the detergent cup 1473, as will be described later, detergent stored in the detergent cup 1473 may be discharged from the detergent cup 1473 through the detergent cup discharge hole 1474 of the detergent cup 1473, and may be transferred to the inside of the detergent container 147. The detergent stored in the detergent container 147 may be discharged to the outside of the storage unit 140 through the detergent discharge hole 1411, so that the detergent may be transferred to the inside of the lower case 120.

In addition, as will be described later, detergent discharged from the storage unit 140 and transferred to the inside of the lower case 120 may be discharged to the outside of the lower case 120 through the drain hole 122 along with water supplied from the upper case 130, so that the detergent and the water can be supplied into the tub 20 or the drum 30.

Meanwhile, the detergent discharge hole 1411 of the storage unit 140 may be located at the bottom surface 141 of the storage unit 140. That is, the detergent discharge hole 1411 may be provided to open the detergent container 147 downward. Detergent discharged through the detergent discharge hole 1411 may be transferred onto the bottom surface 121 of the lower case 120.

However, if necessary, the detergent discharge hole 1411 may be provided at a portion other than the bottom surface 141 of the storage unit 140, or the detergent discharge hole 1411 may communicate with the region other than the detergent container 147.

Meanwhile, detergent discharged through the detergent discharge hole 1411 falls from the bottom surface 141 of the storage unit 140, so that the detergent can be scattered by collision with the bottom surface 121 of the lower case 120 while being discharged through the detergent discharge hole 1411.

When detergent is scattered on the bottom surface 121 of the lower case 120, the detergent may remain on the bottom surface 121 of the lower case 120 even after the washing process is finished, so that hygiene characteristics of the detergent supply device 100 may be deteriorated.

Accordingly, an anti-scattering rib 1412 protruding downward may be provided at the bottom surface 141 of the storage unit 140. The anti-scattering rib 1412 may be disposed around the detergent discharge hole 1411 to prevent detergent discharged from the detergent discharge hole 1411 from scattering.

The anti-scattering rib 1412 may be provided in various shapes, and may extend in the circumferential direction of the detergent discharge hole 1411 around the detergent discharge hole 1411, as shown in FIG. 21. Accordingly, detergent that is discharged from the detergent discharge hole 1411 and scattered can be effectively prevented from scattering outside the anti-scattering rib 1412 by the anti-scattering rib 1412.

Figure 22:
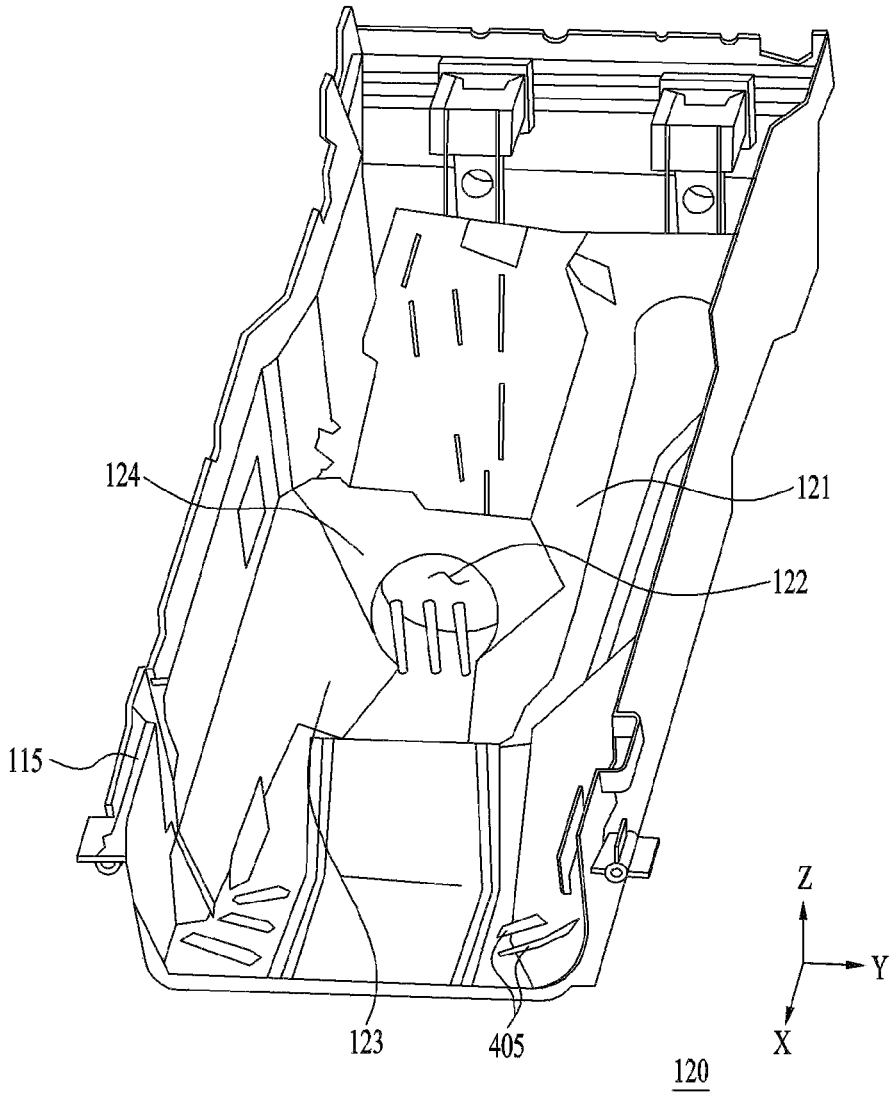
FIG. 22 is a diagram illustrating the inside of a lower case in the laundry treatment apparatus according to an embodiment of the present disclosure.

Meanwhile, FIG. 22 is a view illustrating the inside of the lower case 120 in the laundry treatment apparatus 1 according to the embodiment of the present disclosure. Referring to FIG. 22, the laundry treatment apparatus according to the embodiment of the present disclosure may include a lower case 120 that is provided inside the cabinet 10 and accommodates the storage unit 140 introduced into the cabinet 10.

A drain hole 122 for discharging the detergent discharged through the detergent discharge hole 1411 to the outside may be provided at the bottom surface 121 of the lower case 120, and the storage unit 140 is inserted into the cabinet 10. In this case, at least a portion of the detergent discharge hole 1411 may be located farther backward than the drain hole 122, and the anti-scattering rib 1412 is located at the rear side of the detergent discharge hole 1411, thereby preventing the detergent from scattering backward.

The drain hole 122 provided at the bottom surface 121 of the lower case 120 may communicate with the inside of the tub 20. For example, the drain hole 122 may be connected to the inside of the tub 20 through a drain hose, and detergent and water delivered to the inside of the lower case 120 may be provided to the tub 20 through the drain hole 122 and the drain hose.

At least a portion of the detergent discharge hole 1411 of the storage unit 140 may be located farther backward than the drain hole 122. As described above, the stopper 114 may be located inside the front case 110 so that the storage unit 140 can be pulled out by an optimal distance according to design conditions.

However, when the withdrawal restriction distance of the storage unit 140 is increased, there is a possibility that at least a portion of the detergent discharge hole 1411 located at the bottom surface 141 of the storage unit 140 is located in the front case 110. When the detergent discharge hole 1411 is located at either the rear wall 112 or the opening circumferential wall 111 of the front case 110, detergent leaking through the detergent discharge hole 1411 may be transferred to the inside of the front case 110 during the movement of the storage unit 140.

Since the inside of the front case 110 is separated from the inside of the lower case 120 by the rear wall 112 except for the through hole 1121, detergent delivered to the front case 110 cannot be discharged through the drain hole 122 of the lower case 120, thereby causing a negative effect on hygiene and convenience of use.

Therefore, the detergent discharge hole 1411 of the storage unit 140 may be spaced rearward from the front case 110 so that the detergent discharge hole 1411 is not disposed in the front case 110 when pulled out by the withdrawal restriction distance.

However, when the position of the detergent discharge hole 1411 is changed to a position corresponding to the rear side of the storage unit 140, the detergent discharge hole 1411 may be located farther backward than the drain hole 122 of the lower case 120, and detergent discharged from the rear side of the hole 122 may have difficulty being discharged to the outside of the lower case 120 through the drain hole 122.

Therefore, the anti-scattering rib 1412 is disposed at the rear side of the detergent discharge hole 1411, so that a minimum amount of detergent discharged from at least a portion of the detergent discharge hole 1411 located farther backward than the drain hole 122 can be scattered toward the rear side of the detergent discharge hole 1411 and the drain hole 122.

Furthermore, even if the detergent discharge hole 1411 moves farther backward in response to the increasing withdrawal restriction distance of the storage unit 140, the anti-scattering rib 1412 is provided in the storage unit 140 instead of modifying complex design details for changing the position of the drain hole 122 of the lower case 120, the problem of detergent scattering can be effectively addressed.

Meanwhile, referring again to FIG. 13, the detergent discharge hole 1411 may be located farther backward than the front case 110 in a state in which the withdrawal distance of the storage unit 140 is restricted by the stopper 114.

As described above, the laundry treatment apparatus according to the embodiment of the present disclosure may effectively increase the withdrawal restriction distance of the storage unit 140 to correspond to a design change of the front panel 15, etc., and at the same time the detergent discharge hole 1411 is located farther backward than the front case 110 in a state in which the storage unit 140 is withdrawn by the withdrawal restriction distance, so that the detergent stored in the storage unit 140 can be effectively prevented from leaking into the front case 110.

Referring again to FIG. 21, the anti-scattering rib 1412 may extend in the width direction of the storage unit 140, and the storage unit 140 may include a rib reinforcement unit 1413 that extends rearward from the anti-scattering rib 1412 and is connected to the bottom surface 141 of the storage unit 140.

The anti-scattering rib 1412 may be disposed at the rear side of the detergent discharge hole 1411 to prevent detergent from scattering backward from the detergent discharge hole 1411, and may have a shape extending along the circumference of the rear side of the detergent discharge hole 1411.

In addition, the anti-scattering rib 1412 may extend in the width direction of the storage unit 140 to minimize backward discharge of detergent to be discharged from the detergent discharge hole 1411, and may be disposed at the rear side of the detergent discharge hole 1411.

Furthermore, the storage unit 140 may further include a rib reinforcement unit 1413 to reinforce the rigidity of the anti-scattering rib 1412. The rib reinforcement unit 1413 may be connected together to the anti-scattering rib 1412 and the bottom surface 141 of the storage unit 140.

That is, the rib reinforcement unit 1413 may extend rearward from the anti-scattering rib 1412, and may extend downward from the bottom surface 141 of the storage unit 140. The rigidity of the anti-scattering rib 1412 can be effectively secured by the rib reinforcement unit 1413.

Meanwhile, the extended length of the anti-scattering rib 1412 may be provided to be longer than the width of the detergent discharge hole 1411, thereby preventing the detergent discharged from the detergent discharge hole 1411 from scattering backward.

Figure 23:
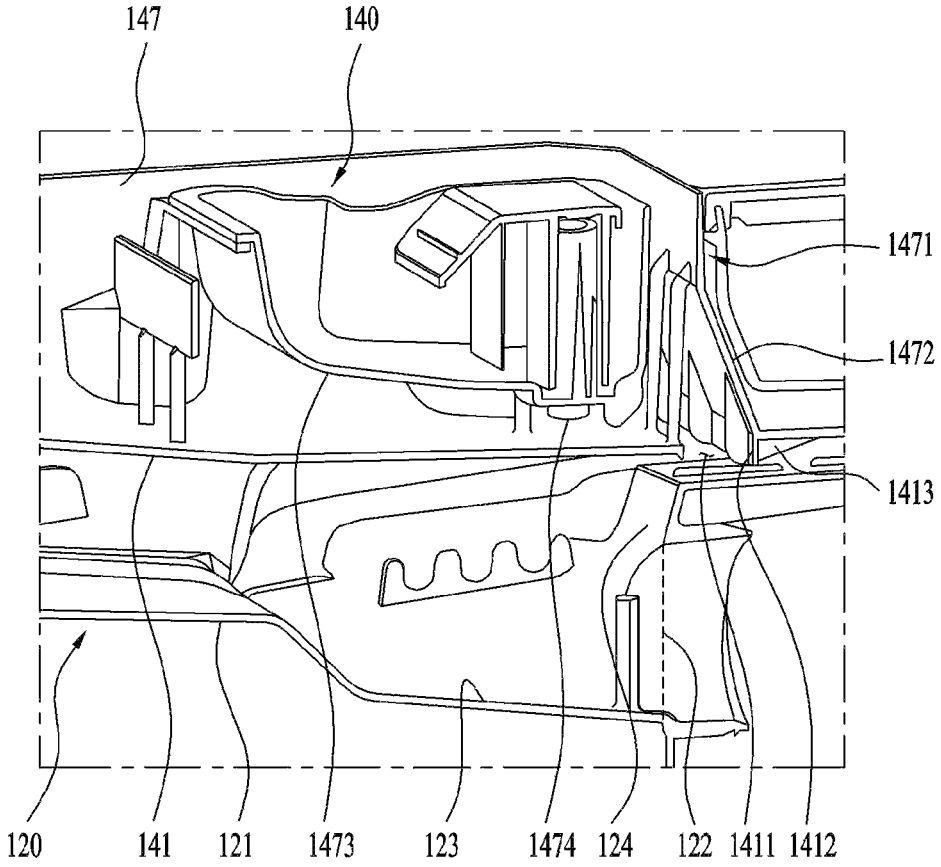
FIG. 23 is a cross-sectional view illustrating the lower case and the storage unit for use in the laundry treatment apparatus according to an embodiment of the present disclosure.

Meanwhile, FIG. 23 is a cross-sectional view illustrating the inside of the lower case 120 and the inside of the storage unit 140 according to the embodiment of the present disclosure.

Referring to FIGS. 22 and 23, the bottom surface 121 of the lower case 120 may have a stepped shape so that the rear side of the drain hole 122 is located higher than the front side of the drain hole 122.

For example, the lower case 120 may be provided at the bottom surface 121 of the lower case 120, may be located at the front side of the drain hole 122, and may include a drain groove 123 recessed downward to guide flow of detergent to the drain hole 122. The drain hole 122 may be provided at the rear surface 124 of the drain groove 123 and may be opened forward.

Specifically, the bottom surface 121 of the lower case 120 may be provided in a shape in which the front side of the drain hole 122 is further recessed downward toward the rear side of the drain hole 122. That is, the bottom surface 121 of the lower case 120 may have a shape in which the rear side of the drain hole 122 is stepped higher than the front side.

For example, a drain groove 123 may be formed at the bottom surface 121 of the lower case 120, and a drain hole 122 may be formed at the rear surface 124 of the drain groove 123. The drain groove 123 may have a shape that is recessed downward from the front side of the drain hole 122, and may allow detergent and water provided to the bottom surface 121 of the lower case 120 to flow toward the drain hole 122.

In addition, the drain hole 122 may be formed at the rear surface 124 of the drain groove 123 to be opened forward from the drain groove 123. Accordingly, detergent and water flowing along the drain groove 123 at the bottom surface 121 of the lower case 120 may have minimal flow resistance, and may be discharged through the drain hole 122.

Furthermore, the rear side of the drain hole 122 may be coupled to a drain hose, and as the drain hole 122 is opened forward, the drain hose may have a shape extending in the forward and backward directions from the drain hole 122 side, thereby minimizing structural interference with the tub 20.

Meanwhile, due to the shape of the drain groove 123 for discharging detergent and water from the inside of the lower case 120, the bottom surface 121 of the lower case 120 may have a stepped shape in which the rear side of the drain hole 122 protrudes farther upward than the front side of the drain hole 122. Accordingly, it may be disadvantageous for the detergent located at the rear side of the drain hole 122 to flow toward the drain groove 123 or the drain hole 122 and to be discharged.

Accordingly, the anti-scattering rib 1412 may be provided at the rear side of the detergent discharge hole 1411 so that the amount of detergent to be discharged backward from the drain hole 122 can be minimized and the detergent can be discharged from the front side of the drain hole 122 through the drain hole 122 along the drain groove 123.

Meanwhile, referring to FIG. 23, the detergent container 147 of the storage unit 140 may store detergent therein, and rear walls (1471, 112) may be provided at the rear side of the detergent container 147. Each of the rear walls (1471, 112) may be constructed such that the lower end connected to the bottom surface 141 of the storage unit 140 is located farther backward than the upper end, the detergent discharge hole 1411 is located in the detergent container 147, and at least a portion of the detergent discharge hole 1411 is located farther backward than the rear walls (1471, 112).

As described above, the detergent container 147 may include a detergent container wall for separating the outer region of the detergent storage box 148 from the inner region of the detergent storage box 148, and the detergent container wall may include the rear wall (1471, 112).

The lower ends of the rear walls (1471, 112) disposed at the rear side of the detergent container 147 may be located farther backward than the upper ends of the rear walls (1471, 112). That is, the rear end of the lower surface of the detergent container 147 may be located farther backward than the rear end of the upper surface of the detergent container 147.

The detergent discharge hole 1411 may be located inside the detergent container 147, and may be provided to open the detergent container 147 to the outside of the storage unit 140. In addition, at least a portion of the detergent discharge hole 1411 may be located farther backward than the upper end of the rear walls (1471, 112).

That is, the storage unit 140 may be configured such that the lower ends of the rear walls (1471, 112) are located farther backward than the upper ends of the rear walls (1471, 112), thereby effectively securing the space for moving the detergent discharge hole 1411 backward. The detergent discharge hole 1411 may be located adjacent to the lower ends of the rear walls (1471, 112) so that the detergent discharge hole 1411 can communicate with the inside of the detergent container 147 and can effectively secure a backward offset distance.

Meanwhile, each of the rear walls (1471, 112) may include a rear inclined portion 1472. The rear inclined portion 1472 may extend to be inclined backward toward the lower ends of the rear walls (1471, 112).

Although FIG. 23 shows the rear inclined portion 1472 that obliquely extends from one side of the rear walls (1471, 112) to the bottom surface of the detergent container 147, the scope or spirit of the present disclosure is not limited thereto, and it should be noted that the rear inclined portion 1472 may extend from the top to the bottom of the rear walls (1471, 112) or may extend from the top to the center of the rear walls (1471, 112). That is, a portion where the rear inclined portion 1472 is formed at the rear walls (1471, 112) can be determined in various ways.

Meanwhile, as described above, the storage unit 140 may store detergent therein, and may further include a detergent cup 1473 seated in the detergent container 147. Additionally, at least a portion of the detergent discharge hole 1411 may be located farther backward than the detergent cup 1473.

The detergent cup 1473 may be seated in the detergent container 147. That is, the detergent cup 1473 may be provided inside the detergent container 147 surrounded by the detergent container wall. The detergent cup 1473 may have an opened upper surface so that detergent can be stored therein. In the detergent container 147, the remaining region other than the detergent cup 1473 and the detergent cup 1473 are separated from each other to store different detergents.

The detergent cup 1473 may have a width corresponding to the detergent container 147, and may be mounted to the detergent container 147. That is, the detergent container 147 may be formed to have a region that is located at the front or rear side of the detergent cup 1473 to be distinguished from the detergent cup 1473, so that detergent can be stored in the region.

Referring to FIG. 23, the detergent cup 1473 may be located at the rear side of the detergent container 147. That is, the detergent cup 1473 may be located at the front side of the rear walls (1471, 112) of the detergent container 147.

The detergent cup 1473 may be disposed at the rear side of the detergent container 147, and a space in which detergent can be stored in a different way from the detergent cup 1473 may be provided at the front side of the detergent container 147.

Meanwhile, the detergent discharge hole 1411 may be located at the rearmost end of the detergent container 147. Accordingly, even though the detergent cup 1473 is located at a front side of the rear walls (1471, 112), the detergent discharge hole 1411 may be located farther backward than the detergent cup 1473, and detergent stored in the detergent container 147 can be discharged to the outside through the detergent discharge hole 1411.

Meanwhile, a detergent cup discharge hole 1474 may be provided at the bottom surface of the detergent cup 1473 so that detergent stored in the detergent cup 1473 is discharged through the detergent cup discharge hole 1474, and at least a portion of the detergent discharge hole 1411 may be located farther backward than the detergent cup discharge hole 1474. As described above, the detergent cup 1473 may be separated from the remaining space within the detergent container 147, and may store detergent therein. The detergent cup 1473 may include a detergent cup discharge hole 1474 through which the detergent stored in the detergent cup 1473 is discharged.

The detergent cup 1473 may be located in the detergent container 147, and detergent discharged through the detergent cup discharge hole 1474 may be transferred to the bottom surface of the detergent container 147. Detergent to be discharged from the detergent cup 1473 from among the entirety of detergent stored in the detergent container 147 may be discharged from the inside of the detergent container 147 to the outside of the storage unit 140 through the detergent discharge hole 1411.

The detergent discharge hole 1411 may be located farther forward than the rear ends of the rear walls (1471, 112), and may be located farther backward than the detergent cup discharge hole 1474 of the detergent cup 1473. The detergent discharge hole 1411 may be located at the rearmost position within the detergent container 147, so that the detergent discharge hole 1411 can be prevented from being located on the front case 110 in a state in which the storage unit 140 is pulled out.

Figure 24:
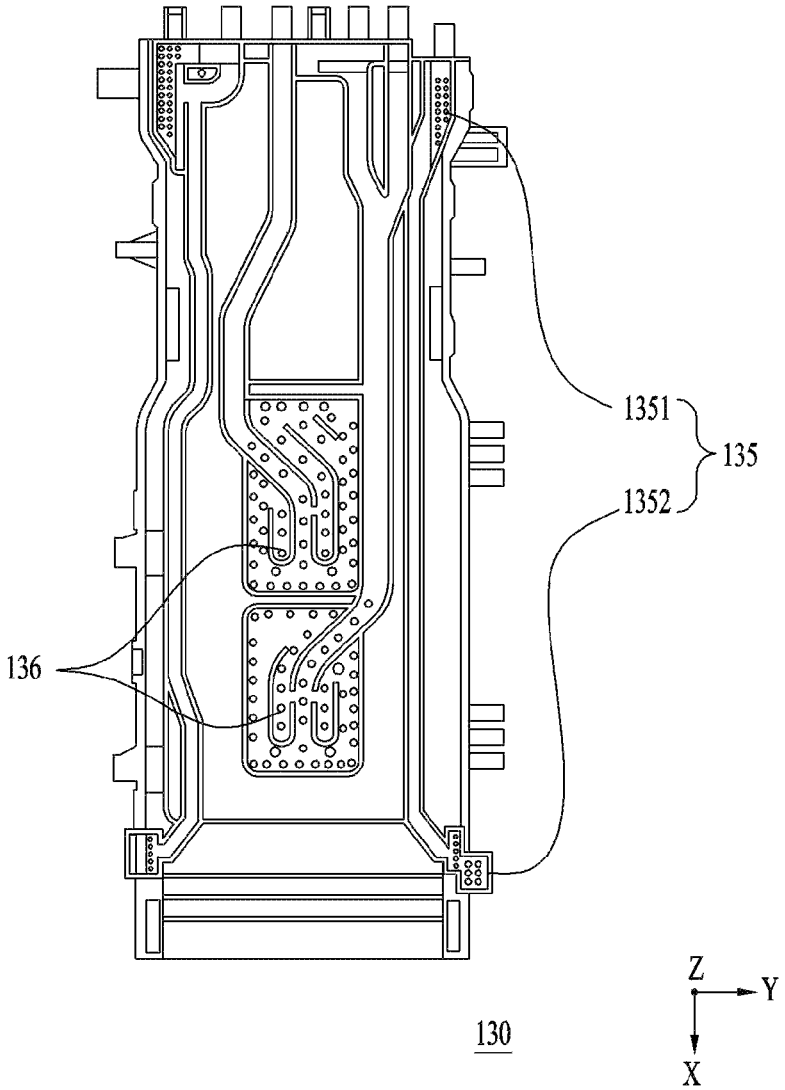
FIG. 24 is a diagram illustrating the upper case for use in the laundry treatment apparatus according to an embodiment of the present disclosure.

Meanwhile, FIG. 24 shows an upper case 130 according to the embodiment of the present disclosure. Referring to FIG. 24, the detergent supply device 100 may further include an upper case 130. The upper case 130 may include a shower unit 135 through which water can be discharged into the lower case 120.

As described above, the upper case 130 may correspond to a water supply unit that is connected to a water supplier and supplies water to the storage unit 140 and the interior of the lower case 120.

Meanwhile, the shower unit 135 of the upper case 130 may be provided to supply water into the interior of the lower case 120 by dropping water from the lower surface of the upper case 130. The water discharged through the shower unit 135 may be transferred to the bottom surface 121 of the lower case 120 so that detergent or the like present on the bottom surface 121 can be washed and then discharged through a drain hole 122.

The laundry treatment apparatus according to the embodiment of the present disclosure can effectively suppress scattering of detergent that is discharged from the detergent discharge hole 1411 through the anti-scattering rib 1412, and at the same time can provide water to the bottom surface 121 of the lower case 120 through the shower unit 135 of the upper case 130, thereby effectively washing away the residual detergent present on the bottom surface 121 of the lower case 120.

Figure 25:
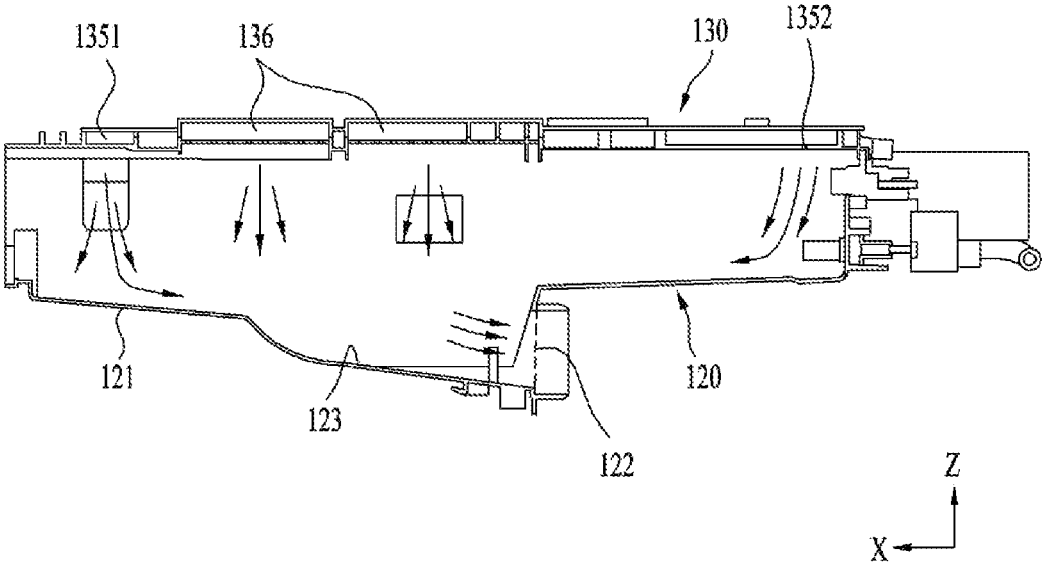
FIG. 25 is a schematic diagram illustrating a flow path of water supplied to the lower case through the upper case in the laundry treatment apparatus according to an embodiment of the present disclosure.

Meanwhile, FIG. 25 schematically shows the flow of water supplied into the lower case 120 by the upper case 130 according to the embodiment of the present disclosure. Referring to FIGS. 24 and 25, the shower unit 135 of the upper case 130 may include a rear shower unit 1352. The rear shower unit 1352 may discharge water into the interior of the lower case 120 while being located farther backward than the drain hole 122, thereby washing or cleaning the rear side of the drain hole 122.

The upper case 130 may further include a detergent water supply unit 136. The detergent water supply unit 136 may supply water to the opened upper surface of the detergent container 147, and water discharged from the detergent water supply unit 136 can be supplied to the detergent container 147 and the detergent cup 1473.

Detergent stored in the detergent container 147 may be discharged to the outside of the storage unit 140 through the detergent discharge hole 1411 along with water supplied from the upper case 130, and thus the drain groove 123 may be provided at the front side of the drain hole 122 so as to guide the water and the detergent to flow into the drain hole 122.

Meanwhile, as described above, at least a portion of the detergent discharge hole 1411 may be located at the rear side of the drain hole 122, and the rear shower unit 1352 provided in the upper case 130 may transfer water from the rear side of the drain hole 122 to the bottom surface 121 of the lower case 120, so that foreign substances or detergents present on the bottom surface of the rear side of the lower case 120 can be washed (or removed).

That is, the laundry treatment apparatus according to the embodiment of the present disclosure can minimize backward scattering of detergent to be discharged from the detergent discharge hole 1411 through the anti-scattering rib 1412 so that the amount of detergent to be scattered backward from the drain hole 122 can be minimized. In addition, water is supplied to a bottom surface of the rear side of the lower case 120 through the rear shower unit 1352 to wash or clean the bottom surface of the rear side of the lower case 120, so that management of the detergent supply device 100 becomes easier and hygiene of the detergent supply device 100 becomes better.

Meanwhile, the shower unit 135 may further include a front shower unit 1351. The front shower unit 1351 located farther forward than the drain hole 122 may discharge water into the interior of the lower case 120 from ahead of the drain hole 122 to clean the front side of the drain hole 122, thereby washing or cleaning the front side of the drain hole 122.

During the insertion or withdrawal process of the storage unit 140, the front side of the detergent discharge hole 1411 may move backward. During the movement process of the storage unit 140, detergent stored in the detergent container 147 may leak to the bottom surface 121 of the lower case 120 through the detergent discharge hole 1411.

Meanwhile, when detergent leaks through the detergent discharge hole 1411 during the withdrawal process of the storage unit 140, detergent leaking from the detergent discharge hole 1411 may leak onto the bottom surface of the front side of the lower case 120, and it is difficult for water discharged from the rear shower unit 1352 to flow toward the front side of the lower case 120, so that residual detergent may remain on the front bottom surface of the lower case 120.

Accordingly, the shower unit 135 of the upper case 130 may include not only the front shower unit 1351 but also the rear shower unit 1352. The front shower unit 1351 may supply water to the inside of the front side of the lower case 120 to wash the bottom surface of the front side of the lower case 120, so that the front side and the rear side of the bottom surface of the lower case 120 can be simultaneously washed, so that management of the detergent supply device 100 becomes easier and hygiene of the detergent supply device 100 becomes better.

It will be apparent to those skilled in the art that various modifications and variations can be made in the present disclosure without departing from the spirit or scope of the inventions. Thus, it is intended that the present disclosure covers the modifications and variations of this invention provided they come within the scope of the appended claims and their equivalents.

The invention claimed is:

1. A laundry treatment apparatus comprising:

a cabinet that includes a front panel having a detergent opening;

a tub provided in the cabinet and configured to accommodate water;

a drum rotatably provided in the tub and configured to accommodate laundry; and a detergent supply device provided in the cabinet and configured to supply detergent into the tub, wherein the detergent supply device includes:

a storage unit configured to store detergent and configured to be inserted into and withdrawn from the cabinet through the detergent opening, and a front case located at a rear side of the detergent opening, and wherein the front case includes:

a rear wall, wherein the storage unit passes through the rear wall, a front extension unit that extends forward from the rear wall and is located at the rear side of the detergent opening, and a stopper that is located forward relative to the rear wall and protrudes from the front extension unit toward the storage unit, the stopper being configured to restrict a withdrawal distance of the storage unit inserted into the cabinet.

2. The laundry treatment apparatus according to claim 1, wherein the front case further includes an opening circumferential wall configured to extend along a circumference of the rear wall, and configured to extend from the circumference of the rear wall toward the detergent opening.

3. The laundry treatment apparatus according to claim 2, wherein:

a sliding protrusion extending in a movement direction of the storage unit is provided at a sidewall of the storage unit; and a sliding groove extending in the movement direction to allow the sliding protrusion to be inserted or slid therein is provided at a portion facing the sidewall of the storage unit within the front extension unit.

4. The laundry treatment apparatus according to claim 3, wherein:

the front case is configured to accommodate a portion of the storage unit;

the detergent supply device further includes a lower case that is located at a rear side of the front case to accommodate a remainder of the storage unit; and the sliding groove is configured to extend along the front extension unit and the lower case.

5. The laundry treatment apparatus according to claim 3, wherein the front extension unit includes:

a first extension unit located above the storage unit and provided with the stopper; and a second extension unit configured to face the sidewall of the storage unit by extending downward from an end portion of the first extension unit, and to include the sliding groove.

6. The laundry treatment apparatus according to claim 2, wherein:

an extension length of the opening circumferential wall extending from the rear wall is longer than an extension length of the front extension unit.

7. The laundry treatment apparatus according to claim 6, wherein:

the stopper is located to be spaced rearward from a front end of the front extension unit.

8. The laundry treatment apparatus according to claim 2, wherein:

the front case is configured to accommodate a portion of the storage unit; and the portion of the storage unit includes an extension-unit receiving groove into which the front extension unit is inserted.

9. The laundry treatment apparatus according to claim 1, wherein the storage unit includes:

a restriction protrusion configured to overlap with the stopper along a movement direction of the storage unit, and wherein the restriction protrusion is configured to be in contact with the stopper during a withdrawal process of the storage unit such that the withdrawal distance of the storage unit is restricted.

10. The laundry treatment apparatus according to claim 9, wherein the storage unit includes:

a withdrawal restriction bar having (i) a first end fixed based on the movement direction and (ii) a second end that defines a free end, wherein:

the restriction protrusion is located at the withdrawal restriction bar so that a position of the restriction protrusion is changed by the second end of the withdrawal restriction bar; and the second end of the withdrawal restriction bar is exposed to an outside through the detergent opening in a state in which the restriction protrusion is in contact with the stopper.

11. The laundry treatment apparatus according to claim 9, wherein the storage unit further includes:

a detergent cup having an opened upper surface to accommodate detergent therein, wherein the detergent cup is configured such that at least a portion of the opened upper surface is exposed to an outside in a state in which the restriction protrusion is in contact with the stopper.

12. The laundry treatment apparatus according to claim 1, wherein:

the detergent supply device further includes:

an upper case disposed at a rear side of the front case and provided to cover the storage unit from an upper side of the storage unit; and the front case includes:

an upper hook extending rearward from the rear wall such that the upper hook is fastened to the upper case and fixes the upper case.

13. The laundry treatment apparatus according to claim 12, wherein:

the front case is configured to accommodate a portion of the storage unit;

the detergent supply device further includes a lower case that is located at the rear side of the front case, has an opened upper surface, and accommodates a remainder of the storage unit; and the upper case is provided to cover the opened upper surface of the lower case.

14. The laundry treatment apparatus according to claim 12, wherein:

the upper hook is coupled to the upper case at an upper side of the upper case.

15. The laundry treatment apparatus according to claim 12, wherein:

the storage unit includes a restriction protrusion that overlaps the stopper in a movement direction of the storage unit;

a protrusion groove into which the restriction protrusion is inserted in a withdrawal process of the storage unit is formed at one surface facing the storage unit within the upper case, so that forward movement of the storage unit is restricted; and the upper hook includes:

a hook protrusion that is inserted into the upper case to allow at least a portion of the hook protrusion to be located in the protrusion groove, thereby preventing the restriction protrusion from being inserted into the protrusion groove.

16. The laundry treatment apparatus according to claim 15, wherein:

the restriction protrusion, the protrusion groove, the hook protrusion, and the stopper are aligned in parallel to each other with respect to the movement direction.

17. The laundry treatment apparatus according to claim 15, wherein:

the upper case includes an open hole for allowing an inside of the protrusion groove to communicate with an outside of the upper case; and the hook protrusion is inserted into the protrusion groove through the open hole.

18. The laundry treatment apparatus according to claim 12, wherein the cabinet further includes:

a panel reinforcement unit located at a rear side of the front panel, wherein:

the panel reinforcement unit includes a coupling reinforcement unit located above the upper hook; and the upper hook is located between the coupling reinforcement unit and the upper case so that the upper hook is prevented from being separated from the upper case.

19. The laundry treatment apparatus according to claim 18, wherein the panel reinforcement unit includes:

a main reinforcement unit coupled to the front panel; and an extension reinforcement unit configured to extend rearward from the main reinforcement unit, wherein the coupling reinforcement unit protrudes from the extension reinforcement unit toward the upper hook.

20. The laundry treatment apparatus according to claim 1, wherein the stopper protrudes downward from a bottom surface of the front extension unit toward a top surface of the storage unit.

21. The laundry treatment apparatus according to claim 20, wherein the storage unit includes a restriction protrusion that protrudes upward from the top surface of the storage unit and configured to contact a front surface of the stopper or a rear surface of the stopper.

* * * * *